US007387373B2

(12) United States Patent
Okazawa et al.

(10) Patent No.: US 7,387,373 B2
(45) Date of Patent: Jun. 17, 2008

(54) LIQUID EJECTING HEAD AND LIQUID EJECTING APPARATUS

(75) Inventors: Noriaki Okazawa, Nagano (JP); Satoru Hosono, Nagano (JP); Munehide Kanaya, Nagano (JP); Akihisa Wanibe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 205 days.

(21) Appl. No.: 10/673,510

(22) Filed: Sep. 30, 2003

(65) Prior Publication Data

US 2004/0114005 A1 Jun. 17, 2004

(30) Foreign Application Priority Data

Sep. 30, 2002 (JP) ..... P.2002-286133
Sep. 30, 2002 (JP) ..... P. 2002-286135
Oct. 29, 2002 (JP) ..... P. 2002-314319

(51) Int. Cl.
*B41J 2/45* (2006.01)

(52) U.S. Cl. ..... 347/70; 347/72

(58) Field of Classification Search ..... 347/59, 347/68, 70, 71

See application file for complete search history.

(56) References Cited

U.S. PATENT DOCUMENTS 5,604,522 A * 2/1997 Miura et al. ..... 347/70
5,880,763 A * 3/1999 Tanaka et al. ..... 347/70
6,010,209 A * 1/2000 Kitahara ..... 347/71
6,213,594 B1 * 4/2001 Kitahara ..... 347/70
6,322,203 B1 * 11/2001 Kitahara ..... 347/70
6,332,671 B1 * 12/2001 Takahashi et al. ..... 347/68
6,547,373 B2 * 4/2003 Kitahara ..... 347/68
6,666,547 B1 * 12/2003 Takahashi et al. ..... 347/70
6,702,431 B1 * 3/2004 Hosono ..... 347/70
6,736,491 B2 * 5/2004 Okazawa et al. ..... 347/68
6,767,084 B2 * 7/2004 Moriya et al. ..... 347/70

FOREIGN PATENT DOCUMENTS

EP 1 024 001 A2 8/2000
EP 1 099 556 A2 5/2001
JP 2000-280474 A 10/2000
JP 2001-239668 A 9/2001
JP 2001-277524 A 10/2001

* cited by examiner

*Primary Examiner*—Matthew Luu
*Assistant Examiner*—Shelby Fidler
(74) *Attorney, Agent, or Firm*—Sughrue Mion, PLLC

(57) ABSTRACT

A liquid ejecting head includes a flow passage formation section and a sealing section. The flow passage formation section includes a plurality of nozzle openings, ejecting liquid therefrom, a plurality of pressure generation parts, corresponding to the nozzle openings respectively, a plurality of liquid supply passages, communicating with the pressure generation parts respectively for supplying liquid thereto, and a plurality of partition wall parts, each separating one liquid supply passage and its corresponding pressure generation part from another liquid supply passage and its corresponding pressure generation part. The sealing section seals the flow passage formation section. The partition wall parts respectively include liquid supply passage partition wall parts which separate adjacent liquid supply passages. The sealing section has a thick part and a thin part. The sealing section which seals an area of the partition wall parts and the liquid supply passage of the flow passage formation section has a thick part and a thin part.

6 Claims, 28 Drawing Sheets

B-B'

C-C'

D-D'

E-E'

F-F'

G-G'

H-H'

I - I'

A-A'

LIQUID EJECTING HEAD AND LIQUID EJECTING APPARATUS

BACKGROUND OF THE INVENTION

This invention relates to a liquid ejecting head for ejecting liquid, such as a record head used with an image record apparatus such as a printer, a color material ejection head used for manufacturing a color filter of a liquid crystal display, etc., an electrode material ejection head used for electrode formation of an organic EL display, an FED (surface light emission display), etc., or a biological organic substance ejection head used for manufacturing a biochip, and a general liquid ejecting apparatus using the liquid ejecting head.

A related ink jet record head (simply, record head) for ejecting ink droplets from nozzle openings by movement of piezoelectric vibrators such as expansion and contraction, etc., has been used with a printer for recording an image and text on record paper. (For example, refer to JP-A-2001-277524.)

FIG. 24 is a schematic exploded perspective view to show a record head 10 in a related art.

As shown in FIG. 24, the record head 10 has a flow passage unit 1, which has a nozzle plate 3 having a large number of nozzle openings 8. A flow passage board 4 is placed so that it is sandwiched between the nozzle plate 3 and a sealing plate 5 (described later).

Pressure generation chambers 7*a* are provided on the flow passage board 4. Also, ink supply passages 7*b* are formed so as to communicate with the pressure generation chambers 7*a*. The ink supply passages 7*b* are further communicated with an ink reservoir 9.

Ink is supplied to the ink reservoir 9 through ink supply holes 5*c* in FIG. 24.

That is, ink is guided from an ink cartridge (not shown) through the ink supply holes 5*c* In the sealing plate 5, etc., into the ink reservoir 9, the ink supply passages 7*b*, and the pressure generation chambers 7*a*.

The pressure generation chambers 7*a* and the ink supply passages 7*b* are placed on the flow passage board 4 like comb teeth as shown in FIG. 24 and are partitioned by partition walls 7*c* and are sandwiched between the sealing plate 5 and the nozzle plate 3, whereby a kind of dosed space is formed. Each of the partition walls 7*c* has an ink flow passage partition wall 7*e* and a pressure generation chamber partition wall 7*d* as later shown in FIG. 25.

The sealing plate 5 is provided with a film-like resin thin film 5*a* on the side of the flow passage board 4 and a metal thin film 5*b* is deposited on the resin thin film 5*a*.

The resin thin film 5*a* of the sealing plate 5 is fixedly secured to the flow passage board 4 with an adhesive, etc., and the metal thin film 5*b* of the sealing plate 5 is fixedly secured to a head case 2 shown in FIG. 24 with an adhesive, etc.

Piezoelectric vibrators 6 shown in FIG. 24 are housed in the head case 2.

FIG. 25 is a schematic representation to show a state in which the sealing plate 5 is bonded, etc., above the pressure generation chambers 7*a* and the ink supply passages 7*b* formed like comb teeth and further the head case 2 is bonded above them. FIG. 26 is a schematic sectional view taken on line A-A' in FIG. 25.

As shown in FIG. 25, the head case 2 in FIG. 24 is bonded onto the ink supply passages 7*b* of the flow passage board 4 through the sealing plate 5. In FIG. 25, solid hatching indicates the metal thin film 5*b* and dashed hatching indicates an area where the head case 2 is bonded.

Specifically, the head case 2 is bonded on the top of the metal thin film 5*b* of the sealing plate 5 formed on the ink flow passage partition walls 7*e* separating the ink supply passages 7*b* as shown in FIG. 26.

However, the head case 2 generally is made of a thermosetting resin, a thermoplastic resin, etc., and the flow passage board 4 of the ink flow passage partition walls 7*e* is made of silicon, etc. Therefore, the head case 2 and the flow passage board 4 are largely different in linear expansion coefficient.

Unlike the flow passage board 4, the head case 2 is made of a resin, etc., and thus easily expands because of water absorption.

Thus, distortion occurs between the head case 2 and the ink flow passage partition wall 7*e* shown in FIG. 26 because of the difference in the linear expansion coefficient, the presence or absence of expansion on water absorption, etc.

In FIG. 26, the distortion largely acts on between the resin thin film 5*a* of the sealing plate 5 and the ink flow passage partition wall 7*e*, a portion wherein the adhesive force is comparatively weak corresponding to the portion where the metal thin film 5*b* is placed, rather than between the head case 2 and the metal thin film 5*b* of the sealing plate 5, a portion wherein the adhesive force is comparatively strong. Therefore, peeling easily occurs between the resin thin film 5*a* and the ink flow passage partition wall 7*e*.

The peeling between the sealing plate 5 having the resin thin film 5*a* and the ink flow passage partition wall 7*e* results in ink leakage between the ink supply passages 7*b*, etc., separated by the ink flow passage partition walls 7*e*, causing the record head 10 to fall, etc.; this is a problem.

Next, referring to FIGS. 27 and 28, an ink jet record head of a second related ink jet record apparatus disclosed in JP-A-2001-277524 is described.

The second related ink jet record apparatus has a roughly similar configuration to that of the first related ink jet record apparatus described above, and therefore components identical with those previously are denoted by the same reference numerals and a description will be omitted.

FIG. 27 is a schematic representation to show the relationship between the pressure generation chambers 7*a* and the ink supply passages 7*b* formed like comb teeth and the metal thin film 5*b* of the sealing plate 5 and the like. FIG. 28 is a schematic plan view to show the relationship between the pressure generation chambers 7*a* and the ink supply passages 7*b* and the metal thin film 5*b* of the sealing plate 5 and the like.

As shown in FIG. 27, the pressure generation chambers 7*a* are formed at the depth of grooves like comb teeth (right in the figure) and the ink supply passages 7*b* are formed so as to communicate with the pressure generation chambers 7*a*.

The ink reservoir 9 is placed to the left of the ink supply passages 7*b*.

The ink supply passages 7*b* are formed on the flow passage board 4, and the sealing plate 5 shown in FIG. 28 is placed thereon.

The hatched portion in FIG. 27 indicates the metal thin film 5*b* of SUS, etc., of the sealing plate 5, and the transparent portion is the resin thin film 5*a* made of a polyphenylene sulfide film, for example of the sealing plate 5.

That is, the unhatched portion of the metal thin film 5*b* of the sealing plate 5 is deleted by etching, etc. Above the pressure generation chambers 7*a* of the flow passage board 4, the metal thin film 5*b* not etched and left is formed, for example, like ellipses placed as island parts 5*d*.

An end part of a piezoelectric vibrator (not shown) is fixedly secured to the island part 905*d*. The piezoelectric vibrator is expanded in the length direction (up and down direction in FIG. 27) by a drive signal.

Thus, as the piezoelectric vibrator is expanded, the island part 905*d* is pressed, causing the pressure in the pressure generation chamber 7*a* to be raised for pressing ink in the pressure generation chamber 7*a* downward (in the nozzle opening direction), thereby ejecting ink from the nozzle opening in FIG. 13.

However, if the piezoelectric vibrator is thus expanded and the pressure in the pressure generation chamber 7*a* is raised, the pressure not only pushes ink in the pressure generation chamber 7*a* into the nozzle opening 8, but also affects the ink supply passage 7*b* communicating with the pressure generation chamber 7*a*, pressing ink in the ink supply passage 7*b* into the ink reservoir 9 side.

The ink reservoir 9 is sealed with the resin thin film 5*a* of the sealing plate 5 and ink pushed back from the pressure generation chamber 7*a* also flows into the ink reservoir 9 and in the adjacent ink supply passage 917*b* directions like an arrow A shown in the figures.

In the arrow A flow, the metal thin film 5*b* exists in the path and the portion cannot be deformed and thus pressure is directly propagated. Further, if ink flows into the ink reservoir 9, pressure is absorbed as the resin thin film 5*a* becomes deformed; however, slight pressure that cannot be absorbed as the resin thin film 5*a* becomes deformed flows in the different ink supply passage 17*b* direction and pressure is propagated. In this case, for example, when ink is ejected through ail nozzles except one in the multiple nozzle configuration, the pressure that cannot be absorbed in the ink reservoir 9 concentrates on the one nozzle and large pressure propagates.

Such a phenomenon is called crosstalk. The face of the surface tension of ink called a meniscus formed on the nozzle is displaced or vibrates as unintended, causing defective ejection in which ink cannot be jetted at the normal timing, in the normal amount, or in the normal direction from the nozzle, the case where ink is erroneously ejected by propagated pressure although an ejection signal is not sent at the worst, or an accident such as non-section of ink although an ejection signal is sent.

It is therefore an object of the invention to provide a liquid ejecting head wherein peeling between a sealing section and a passage partition wall is hard to occur and a failure caused by liquid leakage beyond the partition wall part is hard to occur, and a liquid ejecting apparatus using the liquid ejecting head.

Also, an another object of the invention is to provide a liquid ejecting head for making it possible to prevent crosstalk, which means that pressure applied to one pressure generation part acts on a different pressure generation part, and prevent liquid from being erroneously ejected from the nozzle part corresponding to the different pressure generation part, and a liquid ejecting apparatus using the liquid ejecting head.

SUMMARY OF THE INVENTION

In order to achieve the above object, according to the present invention, there is provided a liquid ejecting head comprising:

a flow passage formation section including:

a plurality of nozzle openings, ejecting liquid therefrom;

a plurality of pressure generation parts, corresponding to the nozzle openings respectively;

a plurality of liquid supply passages, communicating with the pressure generation parts respectively for supplying liquid thereto; and a plurality of partition wall parts, each separating one liquid supply passage and its corresponding pressure generation part from another liquid supply passage and its corresponding pressure generation part; and a sealing section, sealing the flow passage formation section, wherein the sealing section which seals an area of the partition wall parts and the liquid supply passage of the flow passage formation section has a thick part and a thin part.

Preferably, the liquid ejecting head further comprises a head case section which is provided on the flow passage formation section through the sealing section, and the head case having an expansion coefficient different from that of the flow passage formation section. The thick part inside of the area where the head case section is provided on the sealing section is placed in a part of each of the liquid supply passage partition wall parts.

According to the configurations, the thick part of the area on which the head case section is provided is placed in a part of each of the liquid supply passage partition wall parts.

Thus, the thick part is formed only in a part of each of the liquid supply passage partition wall parts existing in the placement area of the head case.

Therefore, when the head case section and the liquid supply passage partition wall parts of the flow passage formation section different in expansion coefficient are fixedly secured through the sealing section, the formation portion of the thick part of the portion wherein rigidity is comparatively strong is limited to a part as compared with the case where thick part is widely placed on the full face of the liquid supply passage partition wall parts existing in the placement area of the head case.

Accordingly, if the head case section and the liquid supply passage partition wall parts differ in expansion coefficient the distortion force is hard to apply in a portion where the thick part is not formed.

Therefore, it becomes hard for the distortion to largely act on between the thin part and the liquid supply passage partition wall part as a whole, and both become hard to peel as a whole. The liquid ejecting head is provided wherein a failure caused by ink leakage beyond the liquid supply passage partition wall part is hard to occur.

Preferably, the thick part is placed in at lease one of a base side close to the pressure generation parts in the liquid supply passage partition wall parts and a tip side away from the pressure generation parts in the liquid supply passage partition wall parts.

According to the configuration, the thick part is placed on the base side of the pressure generation part side in the liquid supply passage partition wall parts or the tip side of the side away from the pressure generation parts.

Thus, if the thick part is placed on the base side of the pressure generation part side, at least the tip side of the side away from the pressure generation parts is not fixedly secured to the head case section. That is, the thick part having higher rigidity than the thin part is not formed on the tip side, etc. Therefore, concentrating of the distortion caused by the expansion coefficient difference between the head case section and the liquid supply passage partition wall parts on the portion between the thin part and the liquid supply passage partition wall parts of the portion wherein rigidity is comparatively weak is relieved on the tip side, etc.

If the thick part is placed on the tip side of the side away from the pressure generation parts, at least the base side of the pressure generation part side is not fixedly secured to the head case section, and concentrating of the distortion is relieved.

Preferably, the thick part placed in the tip sides of the liquid supply passage partition wall parts is formed contiguously.

According to the configuration, the thick part placed on the tip side of the side away from the pressure generation parts allows the sealing section to be reliably connected to the liquid supply passage partition wall parts.

Preferably, the thick part is placed only in the tip side of the liquid supply passage partition wall parts.

According to the configuration, the thick part placed on the tip side of the side away from the pressure generation parts allows the sealing section to be reliably connected to the liquid supply passage partition wall parts. The thick parts are separate, whereby the rigidity of the portion of the sealing section connected to the ink supply passage partition wall parts lowers, making it possible to relieve the stress between the ink supply passage partition wall parts and the sealing section.

Preferably, the sealing section has a bond thick part outside of the area wherein the head case section is placed. The bond thick part is placed in at least one of the tip side of the liquid supply passage partition wall parts and the base side of the liquid supply passage partition wall parts.

According to the configuration, the bond thick part of the flow passage formation section and the sealing section are formed on the tip side of the side away from the pressure generation parts in the liquid supply passage partition wall parts or the base side of the pressure generation part side outside the area wherein the head case section is placed.

Therefore, when the flow passage formation section is fixedly secured to the head case section through the sealing section, the bond thick part functions as jig support and a bond failure does not occur.

Preferably, the thick part has a first thick part and a second thick part which are separated each other. The first thick part is placed only on the base side of the liquid supply passage partition wall parts. The second thick part is placed only on the tip side of the liquid supply passage partition wall parts. A reinforcement member not contributing to expansion is placed in an intermediate part between the tip side and the base side of the liquid supply passage partition wall parts.

According to the configuration, the reinforcement member not contributing to expansion is placed in an intermediate part between the base side and the tip side.

That is, if the head case section and the liquid supply passage partition wall part differ in expansion coefficient, the reinforcement member not contributing to expansion is formed in the intermediate part of the portion wherein the thick part is not formed, so that in the sealing section corresponding to the intermediate part, concentrating of the distortion on the portion between the thin part and the liquid supply passage partition wall parts of the portion wherein rigidity is comparatively weak is relieved.

Since the reinforcement member rather than the thick part is placed in the intermediate part, the strength can be prevented from partially weakening.

Preferably, the thick part and the thin part are separate bodies.

According to the configuration, the shape of the thick part can be made before the thin part is put thereon.

Preferably, the thick part of the sealing section is comprised of a metal thin film.

According to the configuration, the thick part is a metal thin film, so that the shape of the thick part can be formed by etching.

Preferably, the thick part of the sealing section is comprised of a stainless steel thin film. The thin part is comprised of a resin thin film.

According to the configuration, the thick part is made of stainless steel, so that the thick part excellent in chemical resistance can be formed.

Preferably, the liquid ejecting head further comprises a head case section which is provided on the flow passage formation section through the sealing section, and the head case section having an expansion coefficient different from that of the flow passage formation section. The thick part is placed in the liquid supply passage partition wall parts. The thick part to which the head case section is joined has a width smaller than a width of the corresponding liquid supply passage partition wall part.

According to the configuration, the formation width of the thick part of the sealing section placed in the liquid supply passage partition wall part, wherein the head case section is placed is narrower than the width of the corresponding liquid supply passage partition wall part.

That is, if the head case section and the liquid supply passage partition wall part of the flow passage formation section differ in expansion coefficient such as linear expansion coefficient are bonded, etc., through the sealing section, the formation width of the thick part placed in the liquid supply passage partition wall part is narrower than the width of the corresponding liquid supply passage partition wall part.

Thus, the thick part is always placed in the portion joined to the corresponding liquid supply passage partition wall part and space exists between one thick part and its adjacent thick part.

Accordingly, if the head case section and the liquid supply passage partition wall part differ in expansion coefficient, the distortion acts on the bond width and thickness is provided, so that the force is also escaped in the falling direction. Concentration of the force between the thin part and the liquid supply passage partition wall part can be relieved as compared with the case where the thick part is formed continuously.

Therefore, it becomes hard for the distortion to largely act on between the thin part and the liquid supply passage partition wall part, and both become hard to peel. The ejecting head is provided wherein a failure caused by ink leakage beyond the liquid supply passage partition wall part is hard to occur.

Preferably, the thick part is provided along a longitudinal direction of each of the liquid supply passage partition wall parts.

According to the configuration, a portion wherein the adhesive force is comparatively strong is placed over the full length of the liquid supply passage partition wall part, so that the head case section can be strongly fixedly secured.

Therefore, while the thick part holds the head case section strongly, peeling between the thin part and the liquid supply passage partition wall part can also be made hard to occur.

Preferably, the sealing section corresponding to a portion where the head case section is placed and the liquid supply passage is placed, is formed with the thin part only. The thick part of the sealing section in the portion where the head case section is placed is formed like comb teeth.

According to the configuration, the bond width of the thick part of the sealing section the liquid supply passage partition wall part becomes narrower, so that peeling between the thin part and the liquid supply passage partition wall part can be made furthermore hard to occur.

Preferably, the liquid ejecting head further comprises a head case section which is provided on the flow passage formation section through the sealing section, and the head case section having an expansion coefficient different from that of the flow passage formation section. The flow passage formation section includes a plurality of island portions which are formed in the liquid supply passages respectively along a longitudinal direction of the liquid supply passages to prevent pressure leakage of the pressure generation parts. The thick part is formed corresponding to the island portions of the flow passage formation section where the head case section is placed. The thick part has a width smaller than a width of the corresponding island portion. The thin part of the sealing section is formed corresponding to the liquid supply passage partition wall part where the head case section is placed.

According to the configuration, the thick part of the sealing section is formed corresponding to the island-like projection of the flow passage formation section where the head case section is placed, and the width of the thick part of the sealing section where the head case section is placed is smaller than the width of the corresponding island-like projection.

Only the resin thin film of the sealing section is formed corresponding to the liquid supply passage partition wall part where the head case section is placed Thus, the thick part is always placed in the portion joined to the corresponding island-like projection of the flow passage formation section, and space exists between one thick part and its adjacent thick part.

Accordingly, if the head case section and the island-like projection of the flow passage formation section differ in expansion coefficient, the distortion acts on the bond width and thickness is provided, so that the force is also escaped in the falling direction. Concentration of the force between the thin part and the island-like projection of the flow passage formation section can be relieved as compared with the case where the thick part is formed continuously.

Therefore, it becomes hard for the distortion to largely act on between the thin part and the island-like projection of the flow passage formation section, and both become hard to peel.

Since the joint part of the thin part and the liquid supply passage partition wall part is not directly joined to the head case, both become hard to peel.

The ejecting head is provided wherein a failure caused by ink leakage beyond the liquid supply passage partition wall part is hard to occur.

Preferably, the liquid ejecting head further comprises a head case section which is provided on the flow passage formation section through the sealing section, and the head case section having an expansion coefficient different from that of the flow passage formation section. The thick part of the sealing section placed in the liquid supply passage partition wall part, to which the head case section is joined has an area smaller than an area of the corresponding liquid supply passage partition wall parts.

According to the configuration, the formation area of the thick part of the sealing section placed in the liquid supply passage partition wall part, wherein the head case section is placed is smaller than the area of the corresponding liquid supply passage partition wall part.

That is, if the head case section and the liquid supply passage partition wall part of the flow passage formation section differ in expansion coefficient such as linear expansion coefficient are bonded, etc., through the sealing section, the formation area of the thick part placed in the liquid supply passage partition wall part is smaller than the area of the corresponding liquid supply passage partition wall part.

Thus, the thick part is always placed in the portion joined to the corresponding liquid supply passage partition wall part and space exists between one thick part and its adjacent thick part.

Accordingly, if the head case section and the liquid supply passage partition wall part differ in expansion coefficient, the distortion acts on the bond width and thickness is provided, so that the force is also escaped in the falling direction. Concentration of the force between the thin part and the liquid supply passage partition wall part can be relieved as compared with the case where the thick part is formed continuously.

Therefore, it becomes hard for the distortion to largely act on between the thin part and the liquid supply passage partition wall part, and both become hard to peel. The ejecting head is provided wherein a failure caused by ink leakage beyond the liquid supply passage partition wall part is hard to occur.

Preferably, a plurality of thin parts are formed on the sealing section corresponding to the liquid supply passages.

According to the configuration, the thin parts are formed on the sealing section corresponding to the plurality of liquid supply passages.

Thus, if the pressure in the pressure generation part is raised and acts so as to push liquid in the liquid supply passage into the liquid storage part side, the pressure is released in the thin part.

Therefore, the pressure from the pressure generation part is prevented from acting on, for example, an adjacent pressure generation part through the liquid supply passage and the liquid storage part for erroneously ejecting liquid from the nozzle opening corresponding to the adjacent pressure generation part.

Therefore, the liquid ejecting head makes it possible to prevent crosstalk, which means that pressure applied to one pressure generation part acts on a different pressure generation part, and prevent liquid from being erroneously ejected from the nozzle part corresponding to the different pressure generation part.

Preferably, the sealing section includes a metal thin film and a resin thin film which are overlapped. The resin thin film is placed so as to face the flow passage formation section. The thin parts are formed of the resin thin film with the metal thin film removed.

According to the configuration, the thin parts are formed of the resin thin film with the metal thin film removed.

Thus, if the pressure from the pressure generation part acts on the liquid supply passage, the pressure is released as the resin thin film warps, etc.

The pressure from the pressure generation part is prevented from acting on, for example, an adjacent pressure generation part through the liquid supply passage and the liquid storage part for erroneously ejecting liquid from the nozzle opening corresponding to the adjacent pressure generation part.

Since the thin parts can be easily formed as the metal thin film is removed by etching, etc., the manufacturing cost of the thin parts can be decreased drastically.

Therefore, the liquid ejecting head makes it possible to prevent crosstalk, which means that pressure applied to one pressure generation part acts on a different pressure generation part, and prevent liquid from being erroneously ejected from the nozzle part corresponding to the different pressure generation part at low cost.

Preferably, the flow passage formation section further includes a plurality of partition wall parts which separate the plurality of liquid supply passages respectively. The metal thin film is formed on the sealing section of the portions corresponding to the partition wall parts as the thick part.

According to the configuration, the metal thin film is formed on the sealing section of the portions corresponding to partition wall parts for separating the plurality of liquid supply passages.

Thus, when the sealing section is bonded and fixed to the head case, etc., for example, the partition wall part is bonded to the head case, etc., via the metal thin film, so that peeling is especially hard to occur as compared with the case where the partition wall part is bonded only with the resin thin film.

By the way, if peeling, etc., occurs in the partition wall part, liquid leaks through the peeling portion from the adjacent pressure generation part and liquid supply passage and thus the liquid ejecting head fails.

Therefore, the liquid ejecting head makes it possible to prevent crosstalk, which means that pressure applied to one pressure generation part acts on a different pressure generation part, and prevent liquid from being erroneously ejected from the nozzle part corresponding to the different pressure generation part while avoiding a failure of the liquid ejecting head.

Preferably, an island portion is formed on each of the liquid supply passages so as to prevent a reduction in pressure in each of the pressure generation parts. The thick part is formed on the sealing section corresponding to at least the pressure generation part side of the island portion.

According to the configuration, if each of the liquid supply passages is formed with the island portion for preventing a reduction in pressure in the pressure generation part, the metal thin film is formed on the sealing section corresponding to at least the pressure generation part side of the island portion.

By the way, the island portion is provided for preventing pressure generated in the pressure generation part from escaping as the liquid supply passage is made narrower than the pressure generation part, for example.

Thus, particularly, the metal thin film is formed in the portion corresponding to the boundary of the pressure generation part, of the sealing section corresponding to at least the pressure generation part side of the island portion, so that the rigidity of the sealing section is enhanced and the pressure in the pressure generation part becomes hard to escape.

Therefore, the liquid ejecting head does not cause a pressure failure of the pressure generation part to occur and makes it possible to prevent crosstalk, which means that pressure applied to one pressure generation part acts on a different pressure generation part, and prevent liquid from being erroneously ejected from the nozzle part corresponding to the different pressure generation part while avoiding a failure of the liquid ejecting head.

According to the present invention, there is also provided a liquid ejecting apparatus, comprising:

a liquid ejecting head including:

a flow passage formation section having:

a plurality of nozzle openings, ejecting liquid therefrom;

a plurality of pressure generation parts, corresponding to the nozzle openings respectively;

a plurality of liquid supply passages, communicating with the pressure generation parts respectively for supplying liquid thereto; and a plurality of partition wall parts, each separating one liquid supply passage and its corresponding pressure generation part from another liquid supply passage and its corresponding pressure generation part; and a sealing section, sealing the flow passage formation section, wherein the partition wall parts respectively include liquid supply passage partition wall parts which separate adjacent liquid supply passages;

wherein the sealing section which seals an area of the partition wall parts and the liquid supply passage of the flow passage formation section has a thick part and a thin part.

Preferably, the liquid ejecting head includes a head case section which is provided on the flow passage formation section through the sealing section, and the head case section having an expansion coefficient different from that of the flow passage formation section. The thick part inside of the area where the head case section is provided on the sealing section is placed in a part of each of the liquid supply passage partition wall parts.

According to the configuration, the thick part of the area in which the head case section of the liquid ejecting head is placed is placed in a part of each of the liquid supply passage partition wall parts.

Thus, the thick part is formed only in a part of each of the liquid supply passage partition wall parts existing in the placement area of the head case.

Therefore, when the head case section and the liquid supply passage partition wall parts of the flow passage formation section different in expansion coefficient are fixedly secured through the sealing section, the formation portion of the thick part of the portion wherein rigidity is comparatively strong is limited to a part as compared with the case where thick part is widely placed on the full face of the liquid supply passage partition wall parts existing in the placement area of the head case.

Accordingly, if the head case section and the liquid supply passage partition wall parts differ in expansion coefficient, the distortion fore is hard to apply in a portion where the thick part is not formed.

Therefore, it becomes hard for the distortion to largely act on between the thin part and the liquid supply passage partition wall part as a whole, and both become hard to peel as a whole. The liquid ejecting apparatus having liquid ejecting head is provided wherein a failure caused by ink leakage beyond the liquid supply passage partition wall part is hard to occur.

Preferably, the liquid ejecting head includes a head case section which is provided on the flow passage formation section through the sealing section, and the head case section having an expansion coefficient different from that of the flow passage formation section. The thick part is placed in the liquid supply passage partition wall parts. The thick part to which the head case section is joined has a width smaller than a width of the corresponding liquid supply passage partition wall part.

According to the configuration, the width of the thick part of the sealing section placed in the liquid supply passage partition wall part in the ejecting head, wherein the head case section is placed is narrower than the width of the corresponding liquid supply passage partition wall part.

That is, if the head case section and the liquid supply passage partition wall part of the flow passage formation section differ in expansion coefficient such as linear expansion coefficient are bonded, etc., through the sealing section, the formation width of the thick part placed in the liquid supply passage partition wall part is narrower than the width of the corresponding liquid supply passage partition wall part.

Thus, the thick part is always placed in the portion joined to the corresponding liquid supply passage partition wall part and space exists between one thick part and its adjacent thick part.

Accordingly, if the head case section and the liquid supply passage partition wall part differ in expansion coefficient, the distortion acts on the bond width and thickness is provided, so that the force is also escaped in the falling direction. Concentration of the force between the thin part and the liquid supply passage partition wall part can be relieved as compared with the case where the thick part is formed continuously.

Therefore, it becomes hard for the distortion to largely act on between the thin part and the liquid supply passage partition wall part, and both become hard to peel. The provided liquid ejecting apparatus includes the ejecting head wherein a failure caused by ink leakage beyond the liquid supply passage partition wall part is hard to occur.

Preferably, a plurality of thin parts are formed on the sealing section corresponding to the liquid supply passages.

According to the configuration, the thin parts are formed on the sealing section corresponding to the plurality of liquid supply passages of the liquid ejecting head.

Thus, if the pressure in the pressure generation part is raised and acts so as to push liquid in the liquid supply passage into the liquid storage part side, the pressure is released in the thin part.

Therefore, the pressure from the pressure generation part is prevented from acting on, for example, an adjacent pressure generation part through the liquid supply passage and the liquid storage part for erroneously ejecting liquid from the nozzle opening corresponding to the adjacent pressure generation part.

Therefore, the liquid ejecting apparatus includes the liquid ejecting head which makes it possible to prevent crosstalk, which means that pressure applied to one pressure generation part acts on a different pressure generation part, and prevent liquid from being erroneously ejected from the nozzle part corresponding to the different pressure generation part.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Referring now to the accompanying drawings, there are shown preferred embodiments of the invention.

The embodiments described later are preferred specific examples of the invention and therefore various technically preferred limits are imposed, but the scope of the invention is not limited to the specific embodiments unless otherwise specified.

First Embodiment

Figure 1:
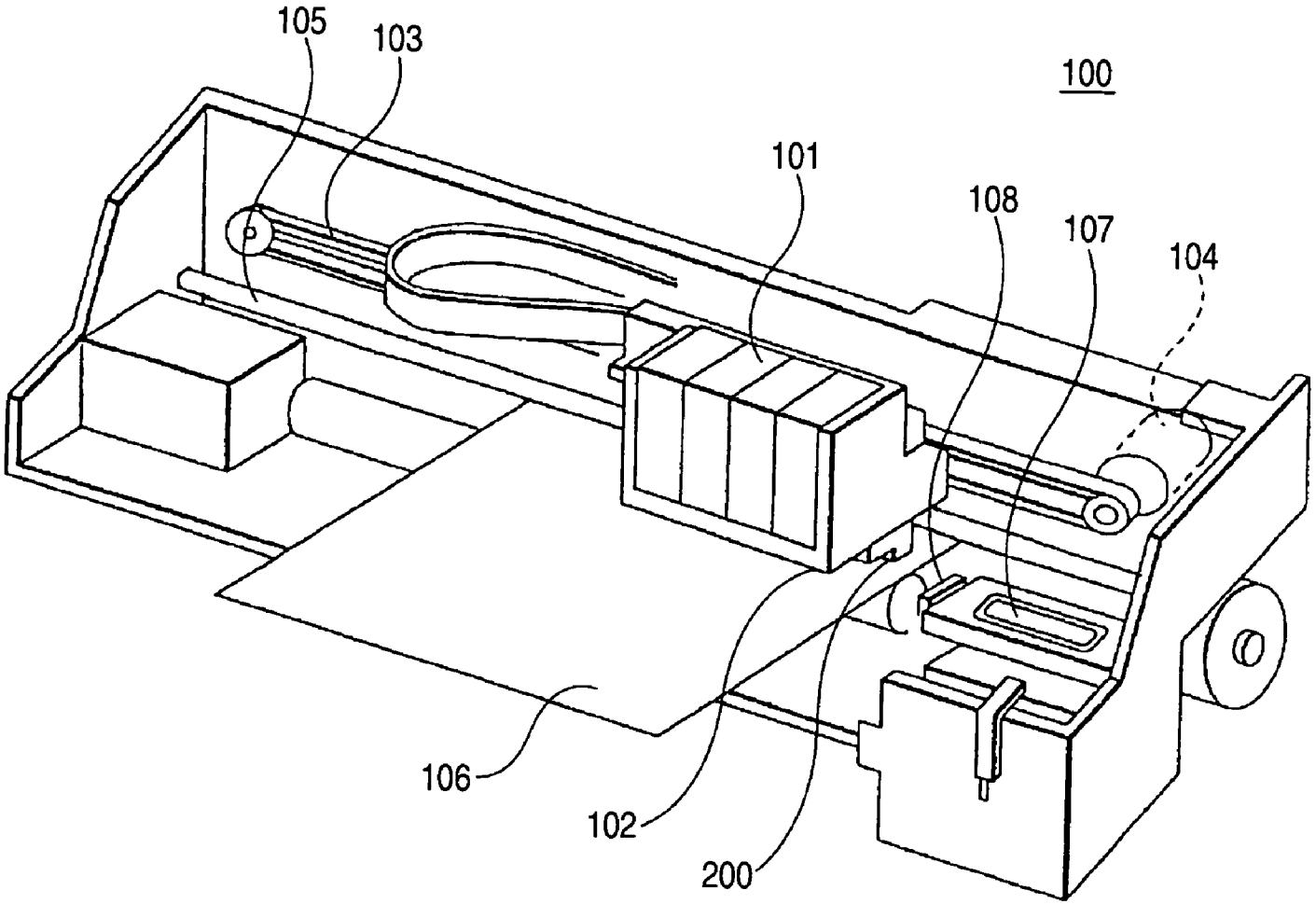
FIG. 1 is a schematic perspective view to show an ink jet record apparatus, for example, of a liquid ejecting apparatus according to a first embodiment of the invention.

FIG. 1 is a schematic perspective view to show an ink jet record apparatus 100, for example, of a liquid ejecting apparatus according to the first embodiment of the invention.

The ink jet record apparatus 100 has an ink cartridge 101 for storing ink, for example, of liquid and an ink jet record head (simply, record head) 200, for example, of a liquid ejecting head on which the ink cartridge 101 is mounted.

The record head 200 is mounted on a carriage 102.

The carriage 102 is connected to a stepping motor 104 via a timing belt 103 and is guided by a guide bar 105 for reciprocating in the paper width direction (main scanning direction) of record paper 106, as shown in FIG. 1.

The carriage 102 is shaped like a box opened to the top and is attached so that the nozzle face of the record head 200 is exposed to the face opposed to the record paper 106, and the ink cartridge 101 is housed in the carriage 102.

Ink is supplied from the ink cartridge 101 to the record head 200. Ink droplets are ejected onto the record paper 106 for printing an image or text on the record paper 106 as a dot matrix while the carriage 102 is moved.

The ink jet record apparatus 100 also includes a cap 107 for preventing drying the nozzle for ejecting ink as much as possible by sealing the nozzle openings of the record head 200 in nonoperating mode, as shown in FIG. 1.

Further, the ink jet record apparatus 100 also has a wiping member 108 for wiping the nozzle face of the record head 200.

Figure 2:
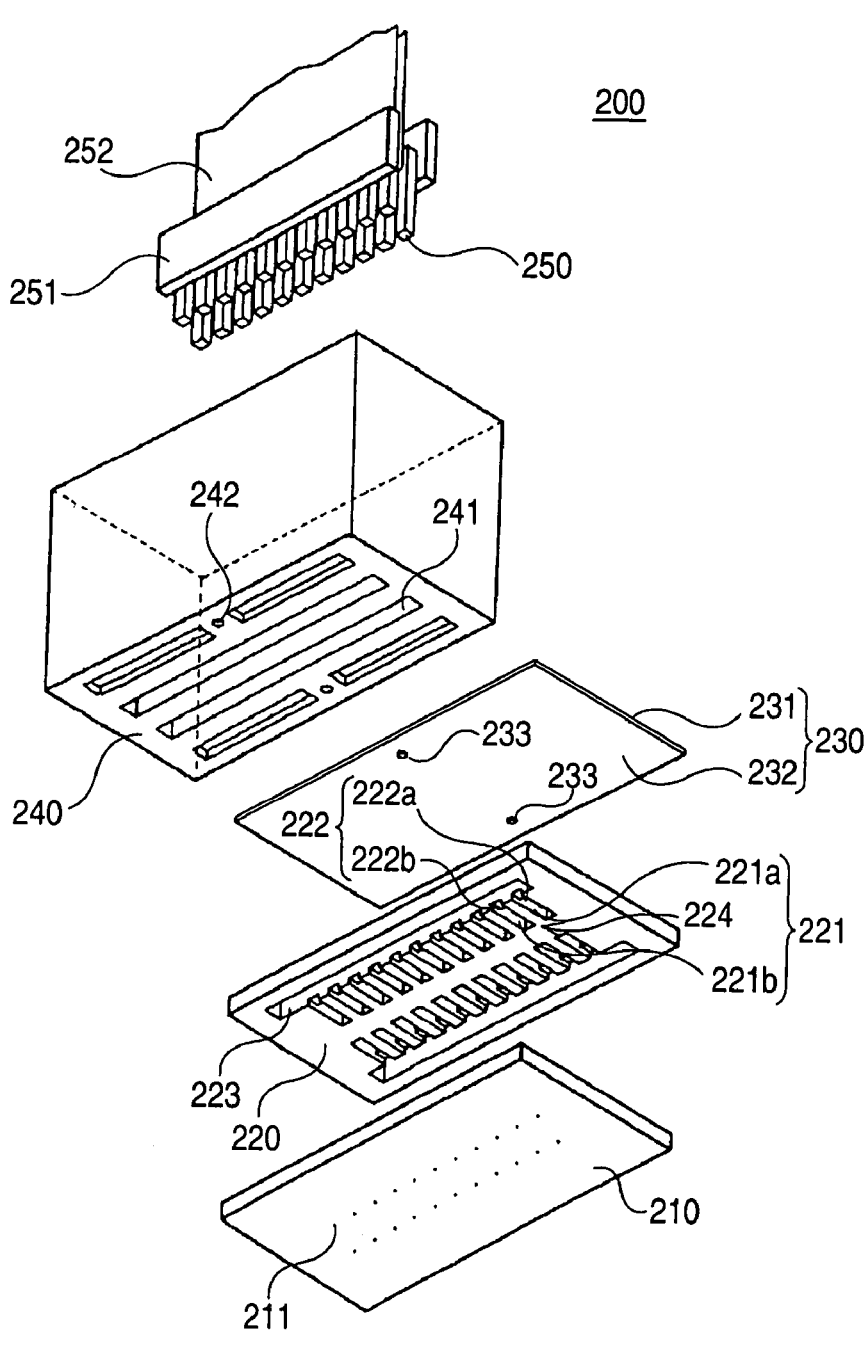
FIG. 2 is a schematic exploded perspective view to show the main part of a record head.

FIG. 2 is a schematic exploded perspective view to show the main part of the record head 200.

As shown in FIG. 2, the record head 200 has a nozzle plate 210 having nozzle openings 211, for example, of a plurality of nozzle openings for ejecting ink.

Pressure generation chambers 221, for example, of a plurality of pressure generation parts formed in a one-to-one correspondence with the nozzle openings 211 are provided on a flow passage board 220, for example, of a flow passage formation section.

The flow passage board 220 has ink supply passages 222, for example, of a plurality of liquid supply passages formed in a one-to-one correspondence with the pressure generation chambers 221 shown in FIG. 2 and formed communicating with the pressure generation chambers 221 for supplying ink thereto.

The flow passage board 220 further has an ink reservoir 223 made to communicate with the ink supply passages 222 for supplying ink to the ink supply passages 222.

The flow passage board 220 is formed with a partition wall 224, for example, of a partition wall part for separating one ink supply passage 222*a* and its corresponding pressure generation chamber 221*a* from another ink supply passage 222*b* and its corresponding pressure generation chamber 221*b* in FIG. 2.

A sealing plate 230, for example, of a sealing section is placed so as to cover the flow passage board 220 having the pressure generation chambers 221, the ink supply passages 222, the ink reservoir 223, and the partition walls 224, as shown in FIG. 2.

The sealing plate 230 has a stainless steel SUS thin film 231, for example, of a thick part formed by lamination and a metal thin film and a PPS (polyphenylene sulfide) film 232, for example, of a thin part and a resin thin film The SUS thin film 231 is thus formed of stainless steel and becomes a thick part excellent in chemical resistance; it also becomes a thick part whose shape can be easily formed by etching because of metal thin film.

Since the SUS thin film 231 and the PPS film 232 of the sealing section 230 are separate, the shape of the SUS thin film 231 can be made by etching before the PPS film 232 is put thereon to form the sealing section 230.

The PPS film 232 of the sealing plate 230 is placed on the flow passage board 220 as shown in FIG. 2 and is fixedly secured with an adhesive, etc.

On the other hand, the nozzle plate 210 is also fixedly secured to the flow passage board 220 with an adhesive, etc., and thus the pressure generation chambers 221, the ink supply passages 222, and the ink reservoir 223 of the flow passage board 220 are sandwiched between the sealing plate 230 and the nozzle plate 210 to form a closed space.

The sealing plate 230 is formed with ink supply holes 233 for supplying ink to the ink reservoir 223.

A head case 240 made of a synthetic resin, for example, of a head case section is placed on the sealing plate 230, as shown in FIG. 2.

The head case 240 is formed with housing spaces 241 piercing up and down and piezoelectric vibrators 250 are inserted thereinto.

The housing spaces 241 are formed in the direction in which rows of the nozzle openings 211 are placed, and are formed corresponding to the nozzle openings 211.

The head case 240 is formed with ink supply holes 242 corresponding to the ink supply holes 233 of the sealing plate 230.

The head case 240 and the flow passage board 220 are thus fixedly secured through the sealing plate 230; since the head case 240 is made of a synthetic resin as described above and the flow passage board 220 is made of silicon, etc., for example, they differ largely in linear expansion coefficient, for example, of expansion coefficient.

For example, the synthetic resin of the head case 240 has a linear expansion coefficient of 12e-6 (1/° C.), while the silicon of the flow passage board 220 has a linear expansion coefficient of 2.5e-6 (1/° C.); they largely differ.

Although the silicon of the flow passage board 220 is free of expansion on water absorption, expansion on water absorption occurs in the synthetic resin of the head case 240.

Figure 3:
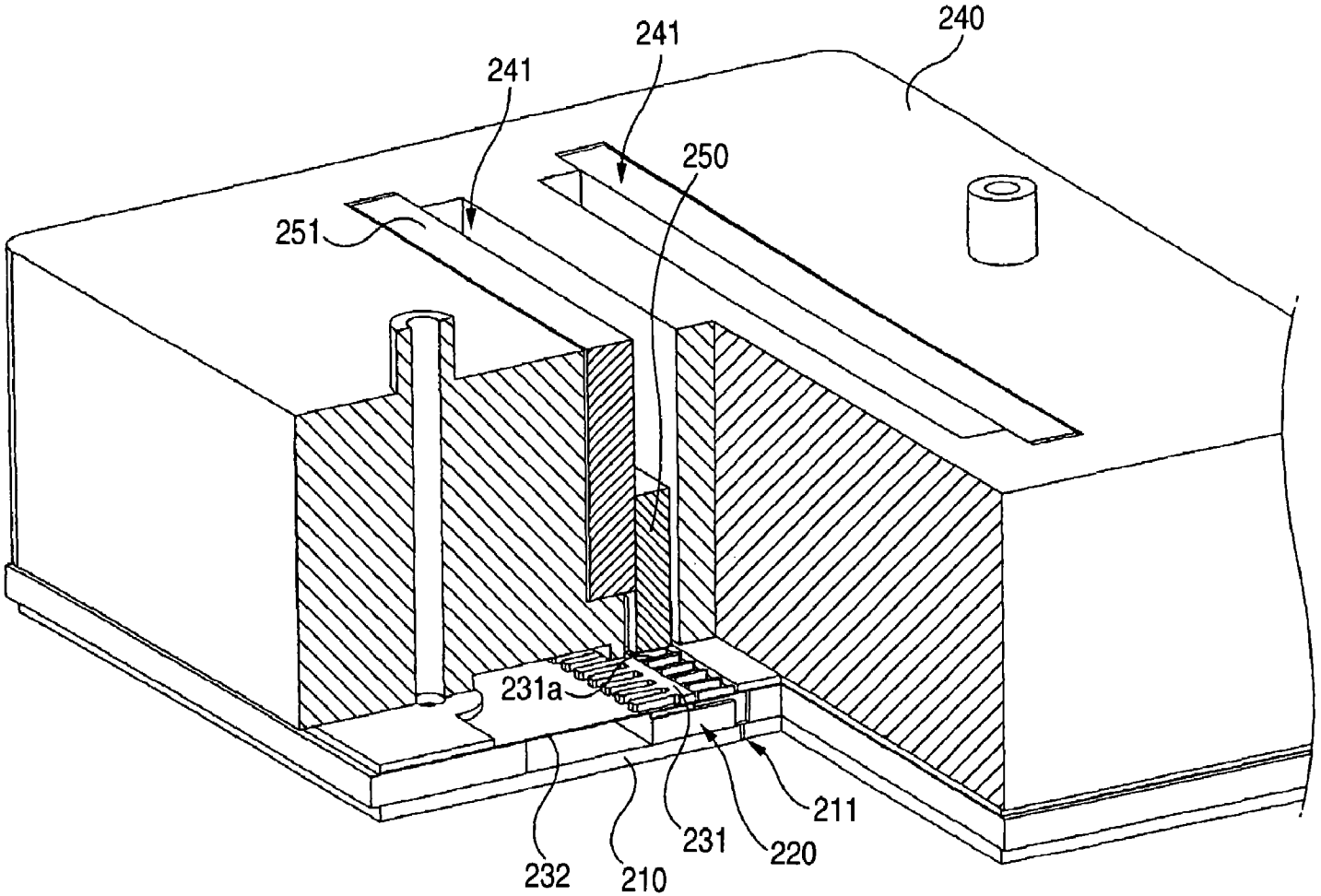
FIG. 3 is a partially schematic expanded sectional view of the record head in FIG. 2.

FIG. 3 is a partially schematic expanded sectional view of the record head 200 in FIG. 2.

The rear end side (upper side in FIG. 2) of the piezoelectric vibrators 250 in FIG. 2 is fixedly secured to a fix board 251 attached to the head case 240 as shown in FIG. 3 and the front end side (lower side in FIG. 2) of the piezoelectric vibrators 250 is fixedly secured to an island part 231*a* formed in the SUS thin film 231 of the sealing plate 230.

Therefore, a drive signal generated by a drive circuit (not shown) in the record head 200 assembled as shown in FIG. 3 is input to the piezoelectric vibrator 250 through a flexible circuit board 252 in FIG. 2, whereby the piezoelectric vibrator 250 is expanded in the longitudinal direction.

At this time, the front end part of the piezoelectric vibrator 250 is fixedly secured to the island part 231*a* and thus presses the island part 231*a* downward for applying pressure to the pressure generation chamber 221 formed just below the island part 231*a*.

On the other hand, ink is supplied from the ink cartridge 101 in FIG. 1 through the ink supply holes 242 of the head case 240 and the ink supply holes 233 of the sealing plate 230 in FIG. 2 to the ink reservoir 223 of the flow passage board 220.

The ink supplied to the ink reservoir 223 is supplied through the ink supply passages 222 to the pressure generation chambers 221 in FIG. 2 placed in a one-to-one correspondence with the nozzle openings 211.

When pressure is applied to the pressure generation chambers 221 thus storing the ink from the piezoelectric vibrators 250 as described above, the ink is ejected from the nozzle openings 211 of the nozzle plate 210 by the pressure.

The head case 240 is fixedly secured to the flow passage board 220 through the SUS thin film 231 and the PPS film 232 of the sealing plate 230.

Figure 4:
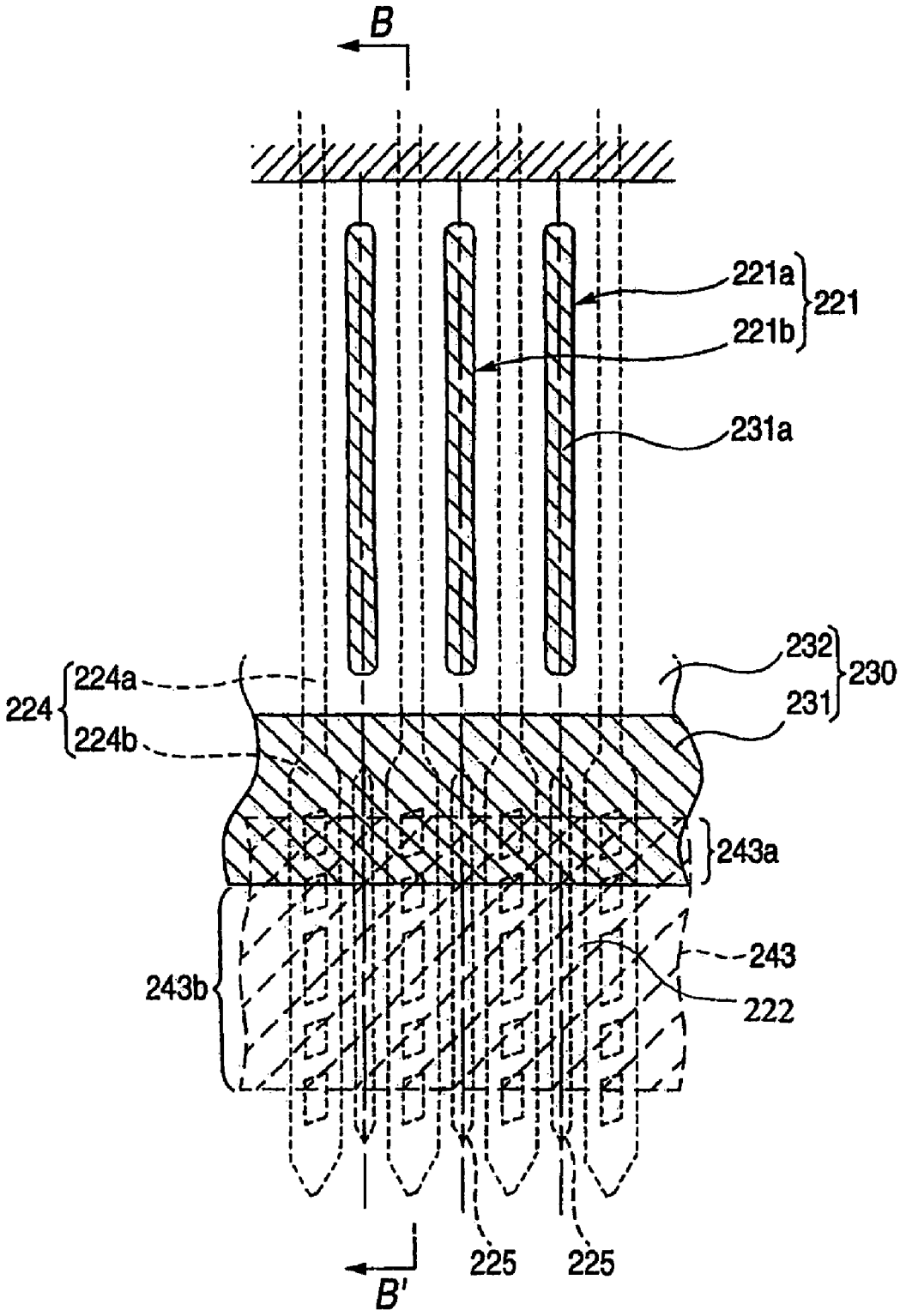
FIG. 4 is a schematic plan view to show a part of joint positions of a head case, a SUS thin film, a PPS film, and partition walls in FIG. 3.
Figure 5:
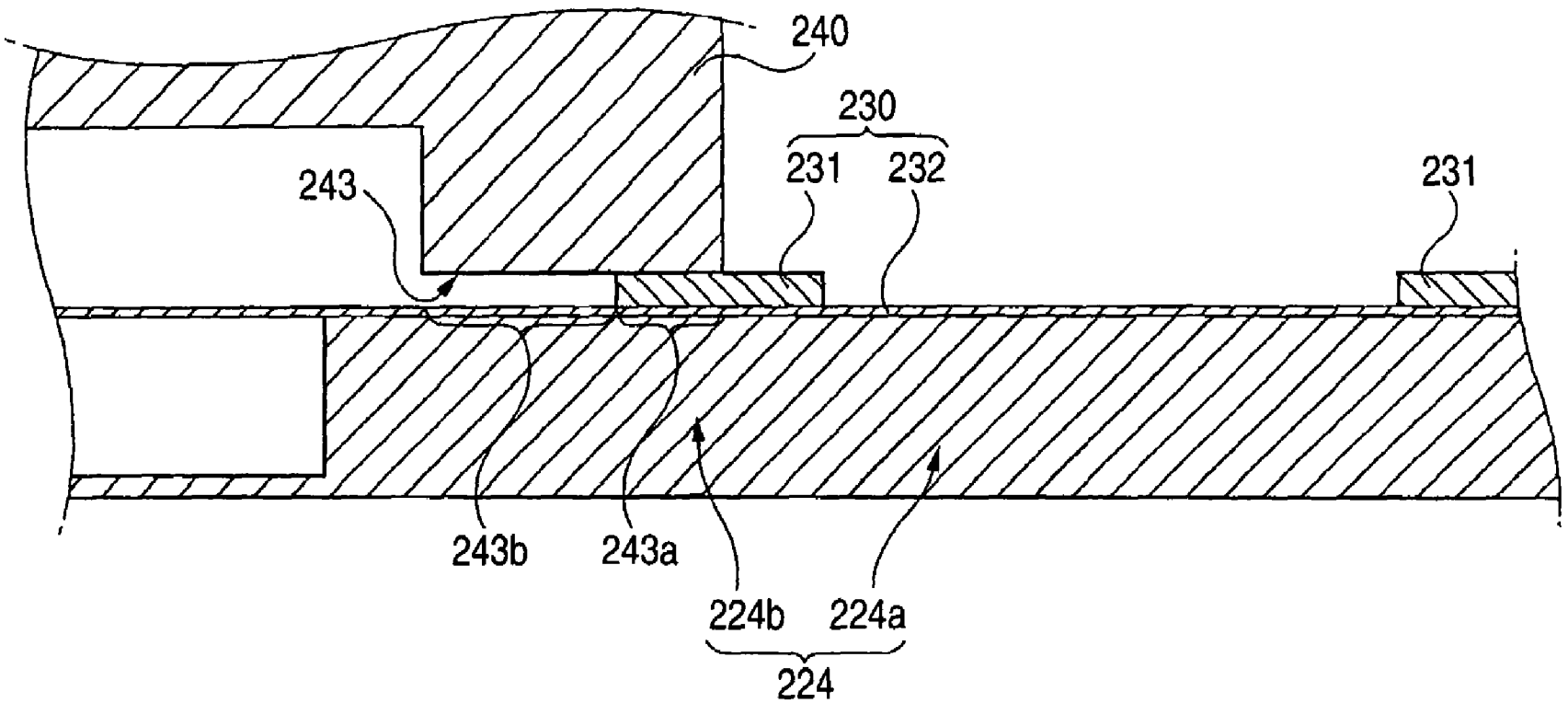
FIG. 5 is a schematic sectional view taken on line B-B' in FIG. 4.

FIG. 4 is a schematic plan view to show a part of joint positions of the head case 240, the SUS thin film 231, the PPS film 232, and the partition walls 224 in FIG. 3. FIG. 5 is a schematic sectional view taken on line B-B' in FIG. 4.

As shown in FIG. 4, the pressure generation chambers 221 provided in a one-to-one correspondence with the nozzle openings 211 of the nozzle plate 210 are paired with the ink supply passages 222 on the flow passage board 220.

The partition walls 224 for separating the ink supply passages 222 and the pressure generation chambers 221 prevent ink from flowing from one into another.

Each of the partition walls 224 has an ink supply passage partition wall 224*b*, for example, of a liquid supply passage partition wall part for separating one ink supply passage 222*a* from another ink supply passage 222*b*, and a pressure generation chamber partition wall 224*a*.

Since each pressure generation chamber 221 communicates with its corresponding ink supply passage 222 as shown in FIG. 4, pressure produced in the pressure generation chamber 221 escapes to the ink supply passage 222.

Then, each ink supply passage 222 is formed with an island-like projection 225 for preventing a reduction in the pressure in the pressure generation chamber 221 as shown in FIG. 4.

The ink flow in the ink supply passage 222 is further narrowed in the presence of the island-like projection 225 and a reduction in the pressure in the pressure generation chamber 221 can be prevented.

As shown in FIG. 3, the PPS film 232 of the sealing plate 230 is fixedly secured with an adhesive, etc., above the partition walls 224 in FIG. 4. The PPS film 232 is shown transparently in FIG. 4.

The SUS thin film 231 deposited on the PPS film 232 is etched to a predetermined shape; in FIG. 4, the etched portion is shown transparently and the remaining portion is hatched.

The hatched remaining parts of the SUS thin film 231 formed like ellipses corresponding to the pressure generation chambers 221 are the island parts 231*a* in FIG. 3, which are fixedly secured to the front end parts of the piezoelectric vibrators 250 for applying pressure to the pressure generation chambers 221 as the piezoelectric vibrators 250 are expanded.

Dashed line hatching in FIG. 4 indicates an area where the head case 240 is bonded onto the sealing plate 230, namely, a head case placement area 243.

The SUS thin film 231 provided in the head case placement area 243 is a connection metal thin film 243*a*, for example, of a connection thick part.

This connection metal thin film 243*a* is placed in a part of each of a plurality of, for example, four ink supply passage partition walls 224*b* shown in FIG. 4, for example, on the base side of the ink supply passage partition walls 224*b* on the pressure generation chamber 221*a* side.

Therefore, the SUS thin film 231 is not formed on the tip side of the ink supply passage partition walls 224*b* in FIG. 4 and thus a free area 243*b* not directly bonded, etc., to the head case 240 is provided as shown in FIG. 5.

In the above configuration, when the head case 240 is bonded to the flow passage board 220 through the sealing plate 230 as shown in FIG. 3 in a situation in which the head case 240 and the flow passage board 220 differ in linear expansion coefficient as described above, the following occurs:

If the head case 240 and the ink supply passage partition wall 224*b* shown in FIG. 5 differ in expansion coefficient in the head case placement area 243 in FIG. 4, stress of distortion occurs in the sealing plate 230 placed between the head case 240 and the ink supply passage partition wall 224*b*.

At this time, in the sealing plate 230, the SUS thin film 231 has higher rigidity than the PPS film 232 and is bonded to the head case 240 and thus distortion does not much act.

However, in the sealing plate 230, the PPS film 232 has low rigidity and thus is easily affected by distortion based on the expansion coefficient difference between the head case 240 and the ink supply passage partition wall 224*b* and a force easily works in the peeling direction between the PPS film 232 and the ink supply passage partition wall 224*b* just below the head case 240 in FIG. 5.

Particularly, in the portion wherein the SUS thin film 231 is formed, the distortion concentrates on the PPS film 232 corresponding to the SUS thin film 231, which becomes a portion where peeling easily occurs.

In this point, in the embodiment, as shown in FIG. 4, the free area 243*b* is provided and the bond portion of the head case 240 and the SUS thin film 231 of the sealing plate 230 is small as compared with the case where the SUS thin film 231 is placed on the full face of the ink supply passage partition wall 224*b*, and is only the portion of the connection metal thin film 243*a* in FIG. 4.

Therefore, the portion of the connection metal thin film 243*a* having high rigidity and strongly bonded to the head case 240 is decreased, so that the portion where the stress of the distortion caused by the expansion coefficient difference concentrates on the PPS film 232 low in rigidity and easily affected by the distortion can also be decreased and the effect of the distortion can be relieved as a whole.

Therefore, peeling of the sealing plate 230 above the ink supply passage partition wall 224*b* caused by the expansion coefficient difference becomes harder to occur.

Accordingly, ink can be prevented from getting over the ink supply passage partition wall 224*b* and leaking from the ink supply passage 222*a* in FIG. 4, for example, to the ink supply passage 222*b*, so that the ink jet record apparatus 100 having the record head 200 wherein a failure is hard to occur can be provided.

Second Embodiment

Figure 6:
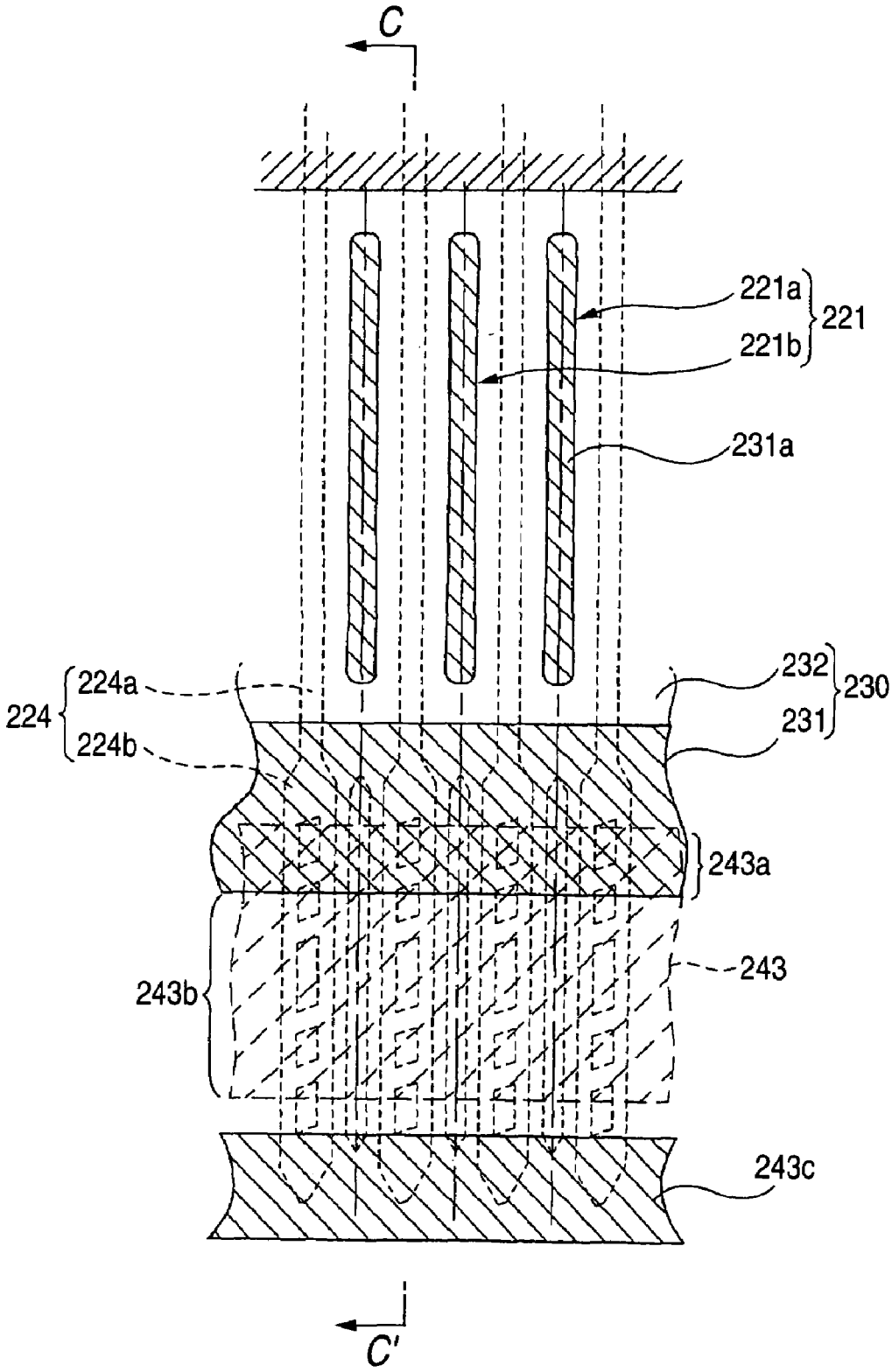
FIG. 6 is a schematic plan view to show the main part of a record head of an ink jet record apparatus of a second embodiment of the invention.

FIG. 6 is a schematic plan view to show the main part of a record head of an ink jet record apparatus of a second embodiment of the invention.

Figure 7:
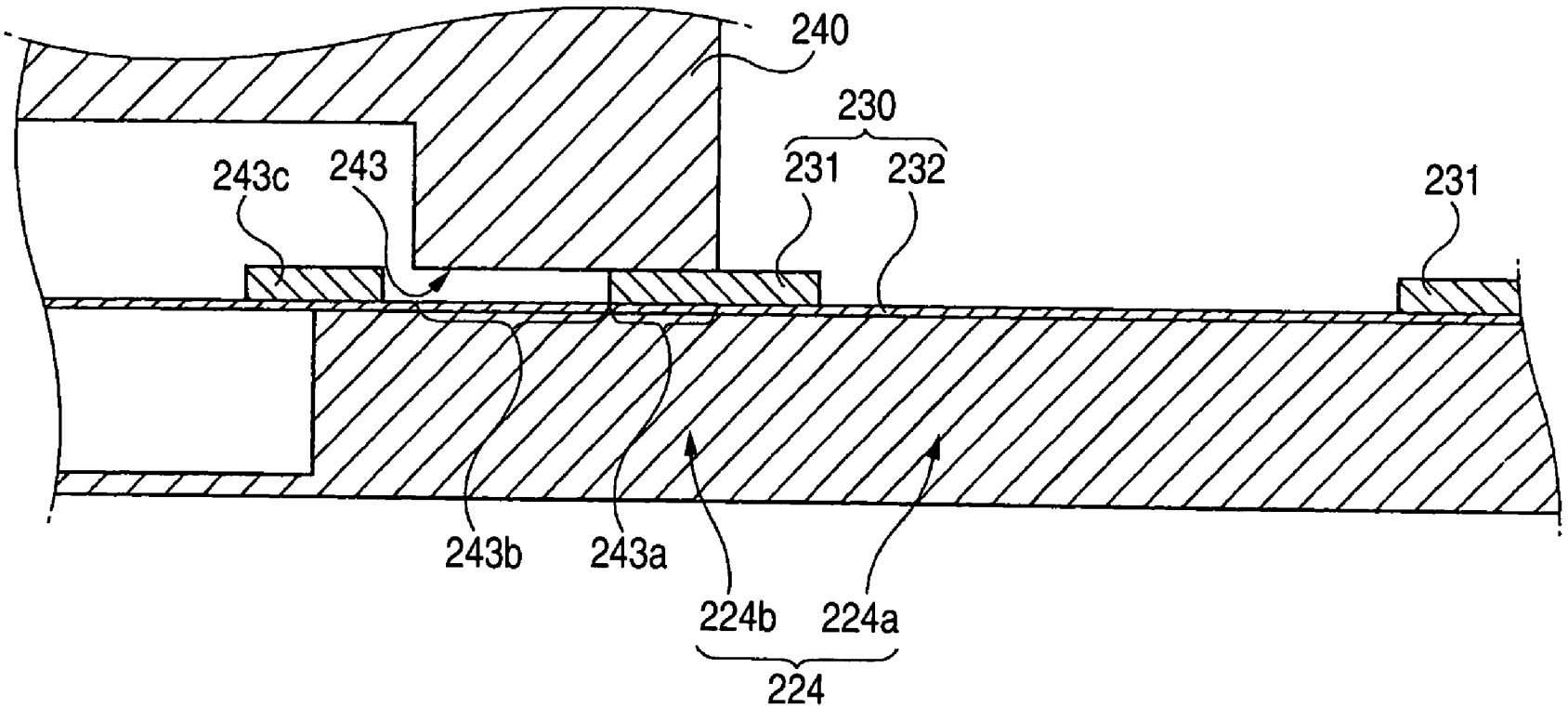
FIG. 7 is a schematic sectional view taken on line C-C' in FIG. 6.

FIG. 7 is a schematic sectional view taken on line C-C' in FIG. 6.

The ink jet record apparatus of the embodiment has a roughly similar configuration to that of the ink jet record apparatus 100 according to the first embodiment described above and therefore components identical with those previously described with reference to the accompanying drawings are denoted by the same reference numerals in FIGS. 6 and 7 and will not be discussed again and a description will be given centering around the difference.

As shown in FIG. 6, in the second embodiment unlike the record head 200 of the first embodiment previously described with reference to FIG. 4, in the tip part on the side away from pressure generation chambers 221 in ink supply passage partition walls 224*b* outside a head case placement area 243, a jig support part 243*c*, for example, of a bond thick part of a flow passage board 220 and a sealing plate 230 is formed in a SUS thin film 231.

Therefore, when the flow passage board 220 is fixedly secured to a head case 240 through the sealing plate 230 with an adhesive, etc., the jig support part 243*c* functions as jig support and a bond failure of the sealing plate 230 and the flow passage board 220 can be prevented.

Third Embodiment

Figure 8:
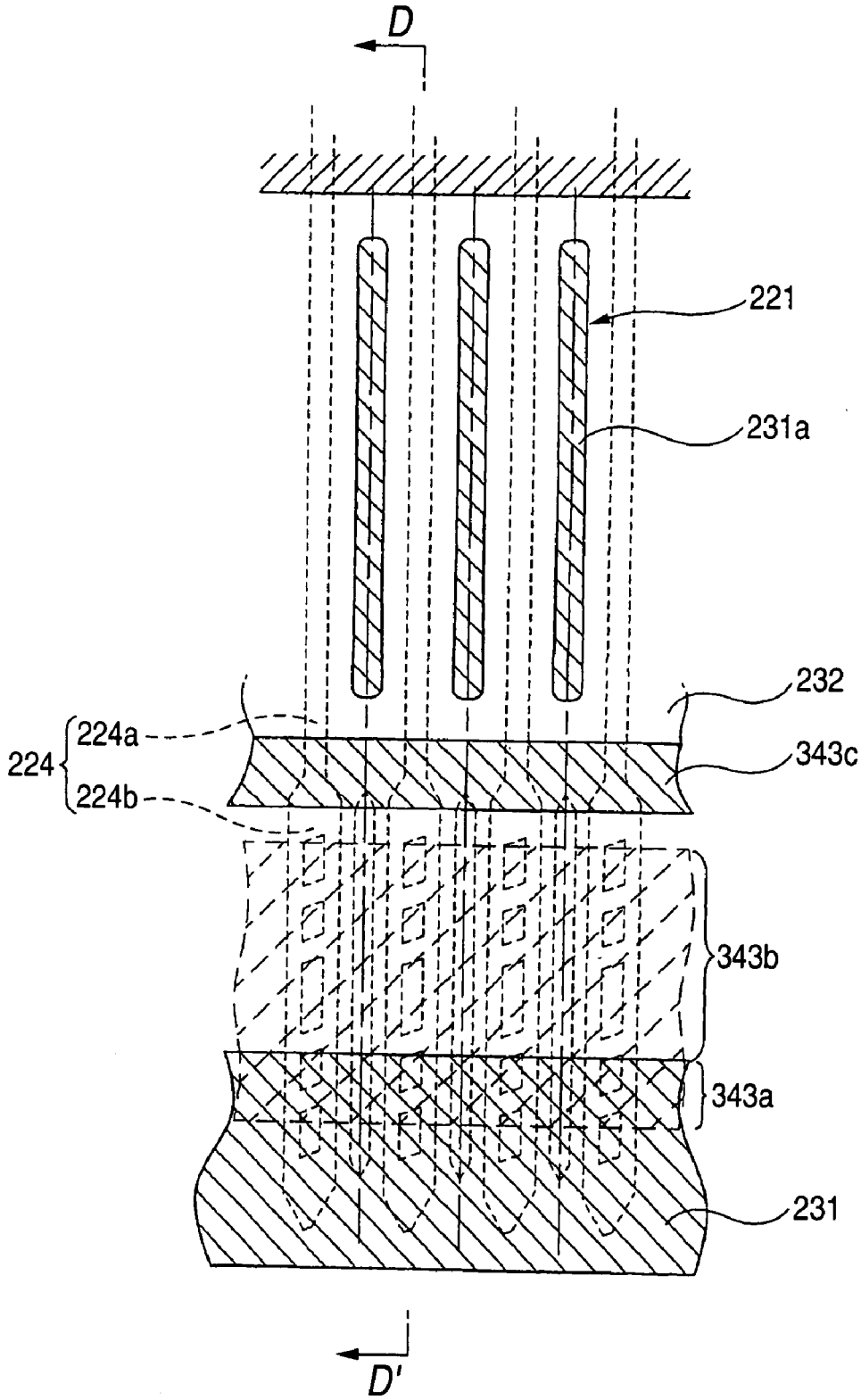
FIG. 8 is a schematic plan view to show the main part of a record head of an ink jet record apparatus of a third embodiment of the invention.
Figure 9:
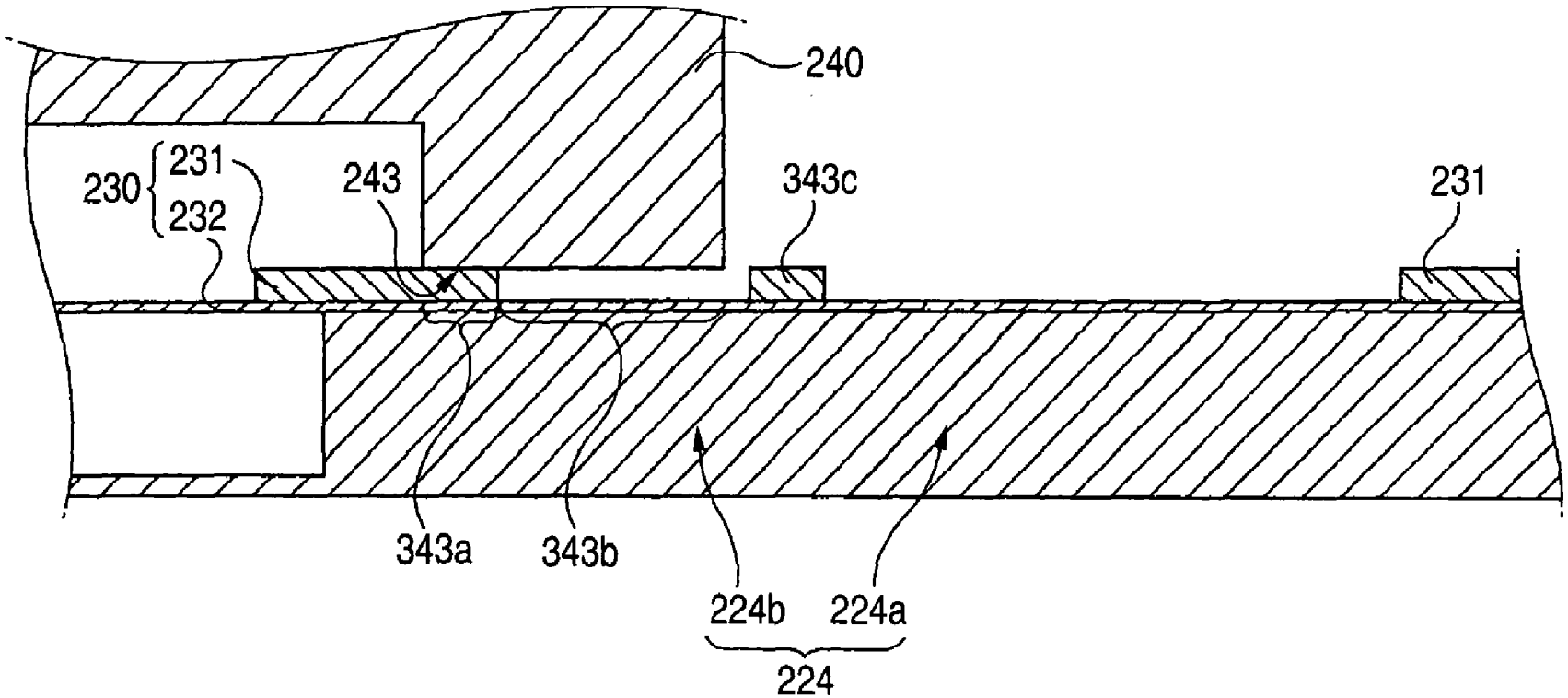
FIG. 9 is a schematic sectional view taken on line D-D' in FIG. 8.

FIG. 8 is a schematic plan view to show the main part of a record head of an ink jet record apparatus of a third embodiment of the invention. FIG. 9 is a schematic sectional view taken on line D-D' in FIG. 8.

The ink jet record apparatus of the embodiment has a roughly similar configuration to that of the ink jet record apparatus according to the second embodiment described above and therefore components identical with those previously described with reference to FIGS. 6 and 7 are denoted by the same reference numerals in FIGS. 8 and 9 and will not be discussed again and a description will be given centering around the difference.

In the third embodiment unlike the second embodiment, a connection metal thin film 343*a* is placed on the tip part side of the side of ink supply passage partition walls 224*b* away from pressure generation chambers 221.

Thus, a free area 343*b* not bonded to a head case 240 is provided on the base side of the pressure generation chamber 221 side of the ink supply passage partition walls 224*b*.

Therefore, the portion having high rigidity and strongly bonded to the head case 240 is only the tip side of the ink supply passage partition walls 224*b* and lessens as a whole, so that concentrating of the stress of the distortion caused by the expansion coefficient difference on the side of a PPS film 232 low in rigidity and easily affected by the distortion can be relieved as a whole.

In the third embodiment unlike the first embodiment, the connection metal thin film 343*a* is formed on the tip side of the ink supply passage partition walls 224*b*.

If the connection metal thin film 343*a* is formed at the position, the connection metal thin film 343*a* of the portion having high rigidity and strongly bonded to the head case 240 is formed small, so that the portion where the stress of the distortion caused by the expansion coefficient difference concentrates on the PPS film 232 low in rigidity and easily affected by the distortion also becomes small and the effect of the distortion can be relieved as a whole, as in the first embodiment.

Therefore, peeling of a sealing plate 230 above the ink supply passage partition wall 224*b* caused by the expansion coefficient difference becomes harder to occur.

Further, in the third embodiment, a jig support part 343*c* is formed on the base side of the pressure generation chamber 221 side of the ink supply passage partition walls 224*b*.

Also in this case, when a flow passage board 220 is fixedly secured to the head case 240 through the sealing plate 230 with an adhesive, etc., the jig support part 343*c* functions as jig support and a bond failure of the sealing plate 230 and the flow passage board 220 can be prevented, as in the second embodiment.

Fourth Embodiment

Figure 10:
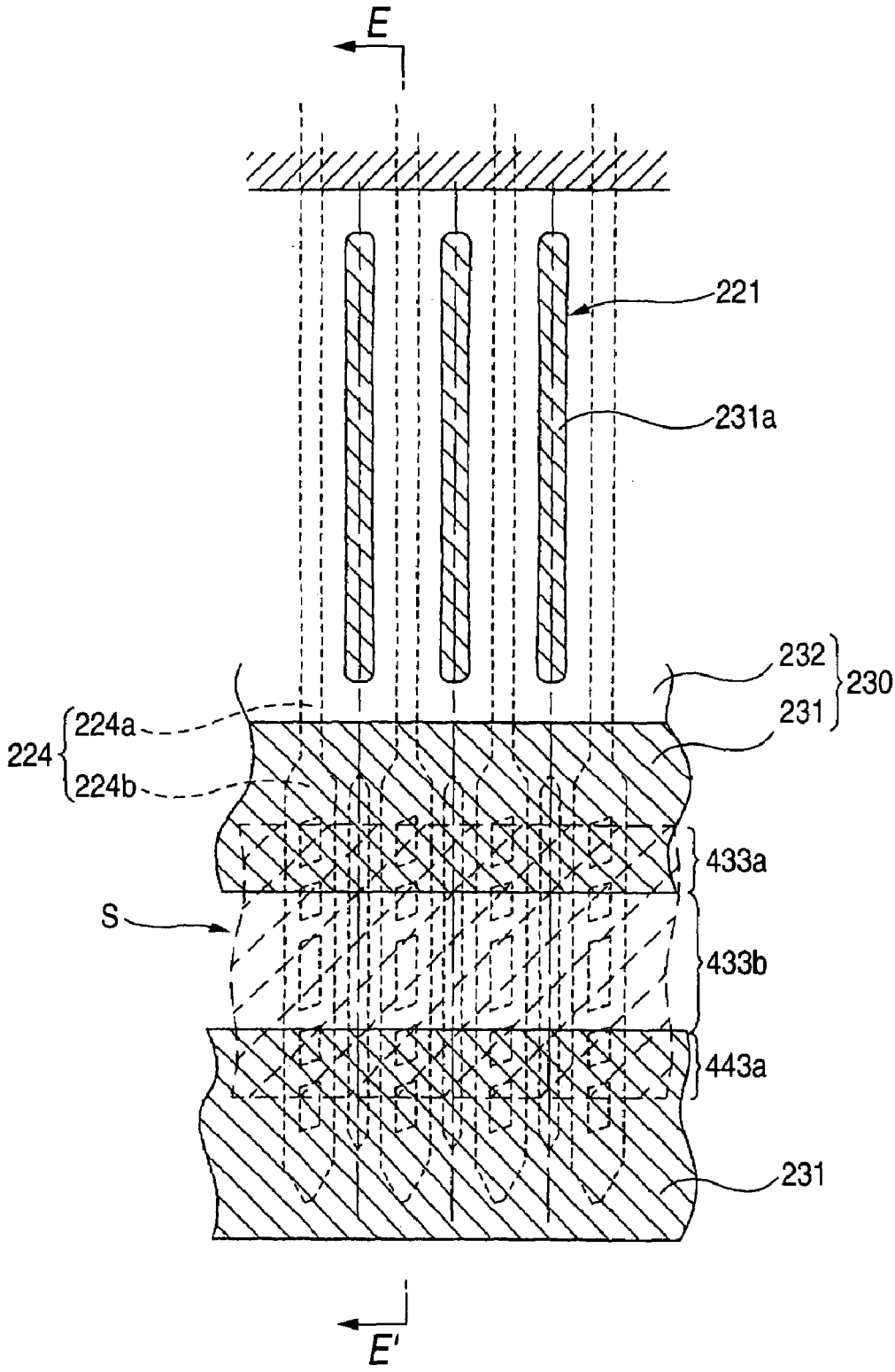
FIG. 10 is a schematic plan view to show the main part of a record head of an ink jet record apparatus of a fourth embodiment of the invention.
Figure 11:
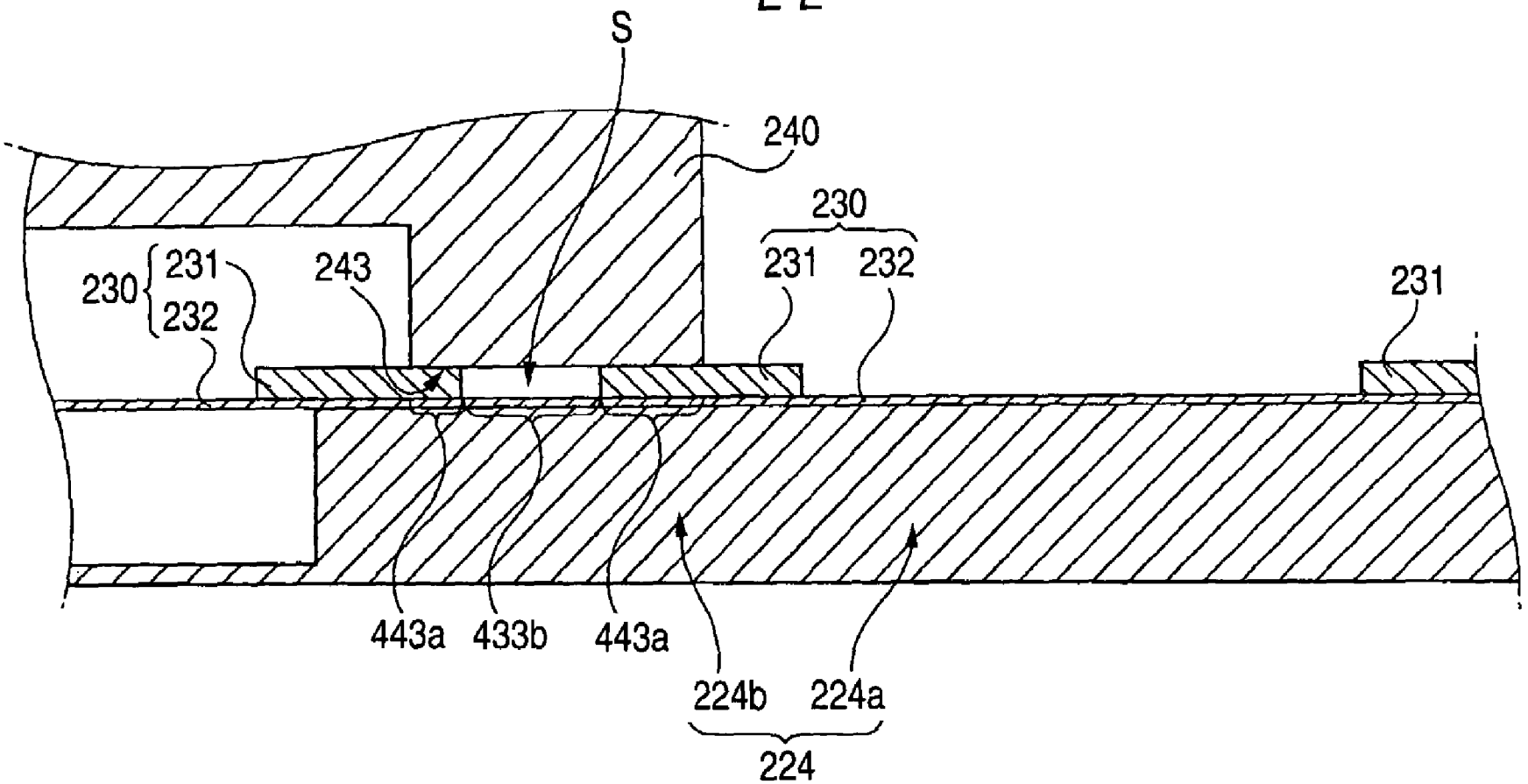
FIG. 11 is a schematic sectional view taken on line E-E' in FIG. 10.

FIG. 10 is a schematic plan view to show the main part of a record head of an ink jet record apparatus of a fourth embodiment of the invention. FIG. 11 is a schematic sectional view taken on line E-E' in FIG. 10.

The ink jet record apparatus of the embodiment has a roughly similar configuration to that of the ink jet record apparatus 100 according to the first embodiment described above and therefore components identical with those previously described with reference to the accompanying drawings are denoted by the same reference numerals in FIGS. 10 and 11 and will not be discussed again and a description will be given centering around the difference.

In the record head of the fourth embodiment, connection metal thin films 443*a* are formed with a spacing on the base part side and the tip side of ink supply passage partition walls 224*b*.

The connection metal thin film 443*a* on the tip side of the ink supply passage partition walls 224*b* is placed contiguously as shown in FIG. 10.

Therefore, the connection metal thin film 443*a* placed on the tip side of the side away from pressure generation chambers 221 allows a sealing plate 230 to be reliably connected to the ink supply passage partition walls 224*b*.

A free area 433*b* is formed in an intermediate part between the two connection metal thin films 443*a*.

The free area 433*b* is formed with a recess part S as shown in FIG. 11. An adhesive, for example, of a reinforcement member not contributing to expansion is placed in the recess part S.

For example, an epoxy-based adhesive, a silicon-based adhesive, etc., is available as the adhesive.

Owing to the configuration, in FIG. 11, a head case 240 and the ink supply passage partition wall 224*b* differ in expansion coefficient and an adhesive not contributing to expansion is placed in the recess part S, so that in the sealing plate 230 corresponding to the recess part S, distortion does not concentrate a portion between a PPS film 232 and the ink supply passage partition wall 224*b*, a portion wherein adhesive force is weak and the effect of the distortion is relieved as a whole.

Since the adhesive rather than a SUS thin film 231 is placed in the recess part S, the strength can be prevented from partially weakening.

Fifth Embodiment

Figure 12:
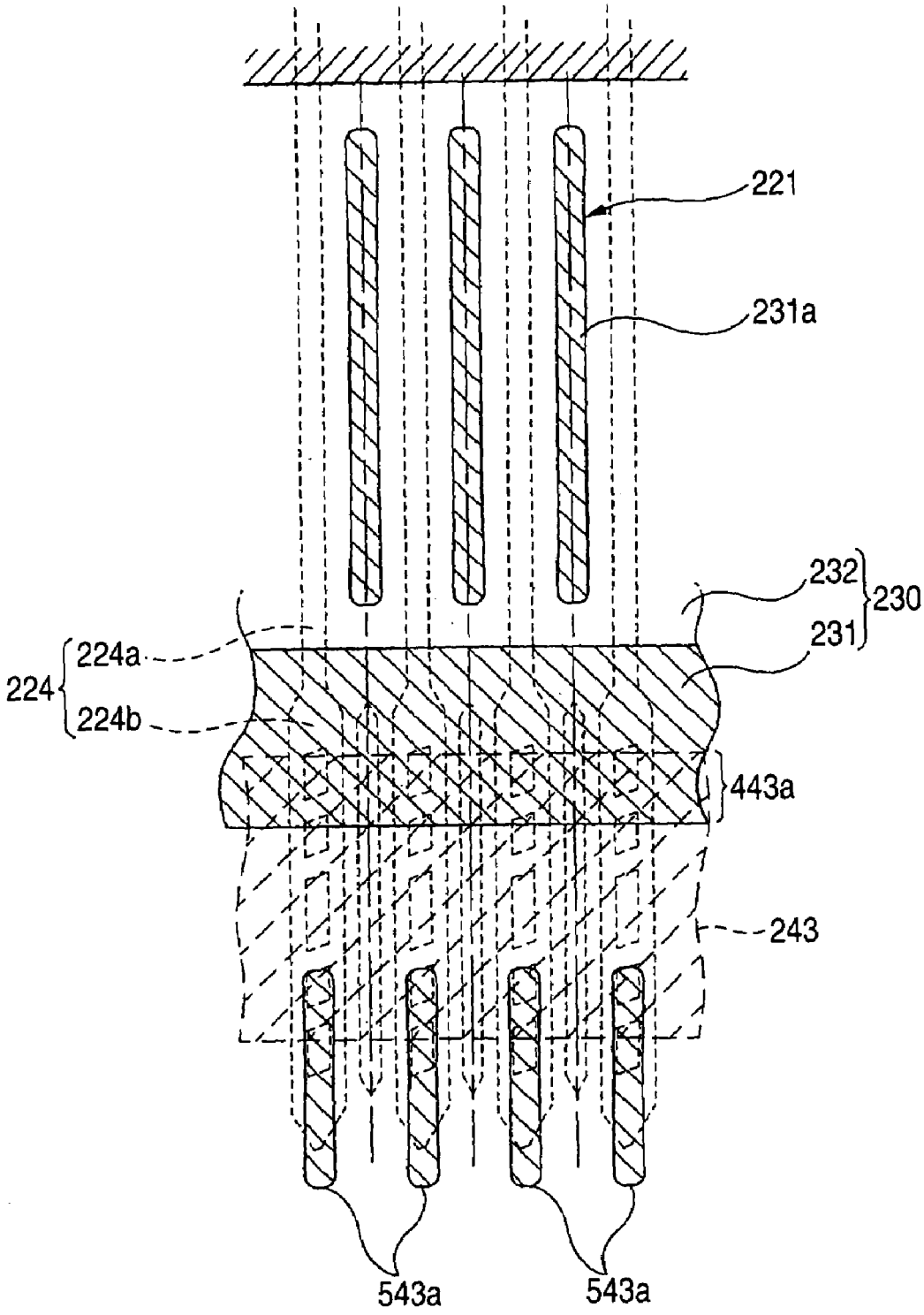
FIG. 12 is a schematic plan view to show the main part of a record head of an ink jet record apparatus of a fifth embodiment of the invention.

FIG. 12 is a schematic plan view to show the main part of a record head of an ink jet record apparatus of a fifth embodiment of the invention.

The ink jet record apparatus of the embodiment has a roughly similar configuration to that of the ink jet record apparatus according to the fourth embodiment described above and therefore components identical with those previously described with reference to FIGS. 10 and 11 are denoted by the same reference numerals in FIG. 12 and will not be discussed again and a description will be given centering around the difference.

The record head of the fifth embodiment differs from the record head of the fourth embodiment in FIG. 10 in connection metal thin film on the tip side of ink supply passage partition walls 224*b*.

That is, in the record head of the fifth embodiment, a plurality of connection metal thin films 543*a* are provided like islands on the tip side of ink supply passage partition walls 224*b*, for example, the connection metal thin films 543*a* are provided in a one-to-one correspondence with pressure generation chambers 221.

That is, the connection metal thin films 543*a* are placed only at the tips of the ink supply passage partition walls 224*b*.

Therefore, the connection metal thin films 543*a* placed on the tip side of the side away from the pressure generation chambers 221 allow a sealing plate 230 to be reliably connected to the ink supply passage partition walls 224*b*. The ink supply passage partition walls 224*b* are separate, whereby the rigidity of the portion of the sealing plate 230 connected to the ink supply passage partition walls 224*b* lowers, making it possible to relieve the stress between the ink supply passage partition walls 224*b* and the sealing plate 230.

Even if the record head is thus formed, the portions of the connection metal thin films 543*a* high in rigidity and strongly bonded to a head case 240 become small, as in each embodiment described above.

Thus, in portions wherein the connection metal thin films 543*a* are not formed, the stress of distortion caused by the expansion coefficient difference does not concentrate on a PPS film 232 low in rigidity and easily affected by the distortion.

Therefore, peeling of the sealing plate 230 above the ink supply passage partition walls 224*b* caused by the expansion coefficient difference becomes harder to occur.

Sixth Embodiment

Figure 13:
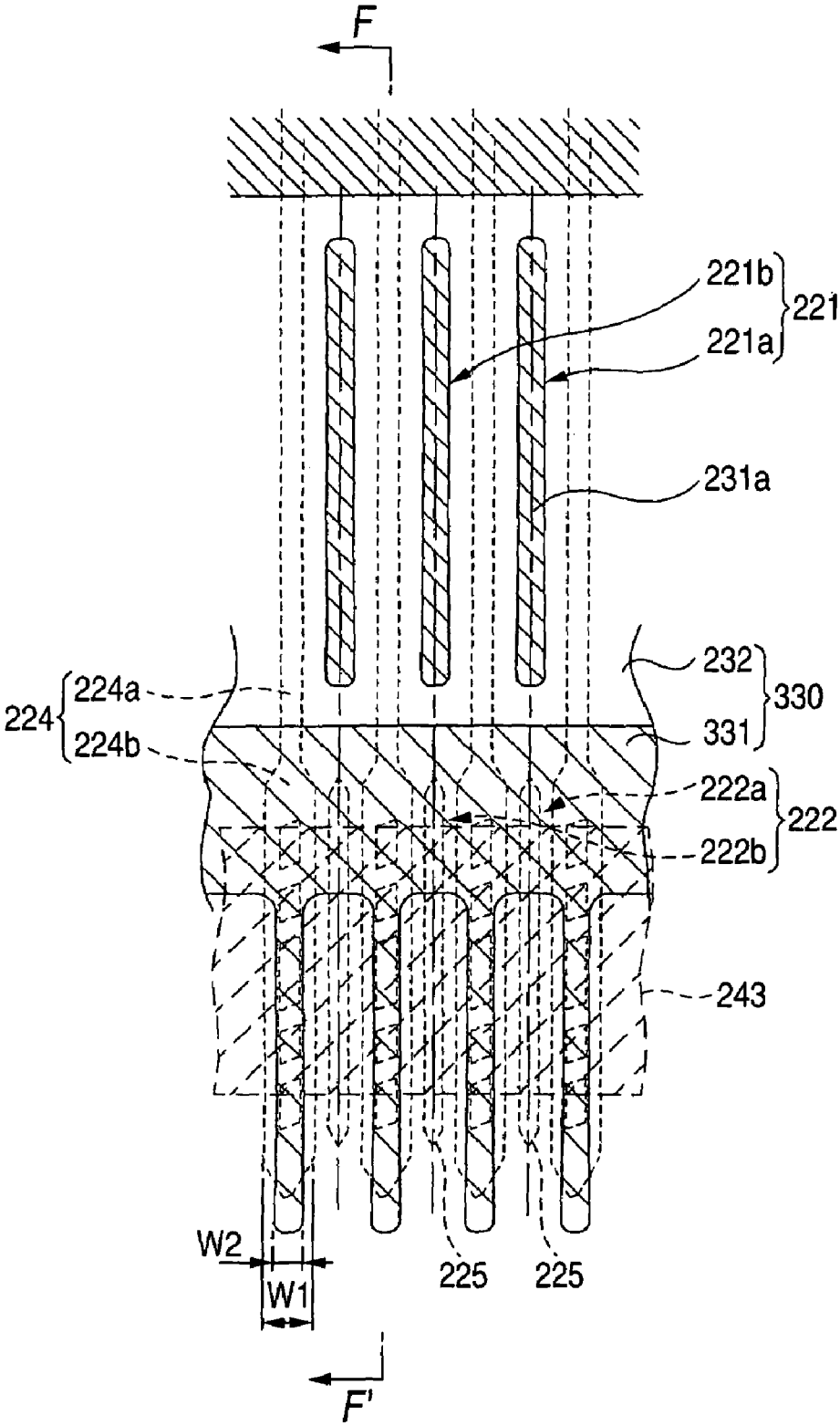
FIG. 13 is a schematic plan view to show a part of joint positions of a head case, a SUS thin film, a PPS film, and partition walls of a recording head of an ink jet record apparatus according to a sixth embodiment of the invention.
Figure 14:
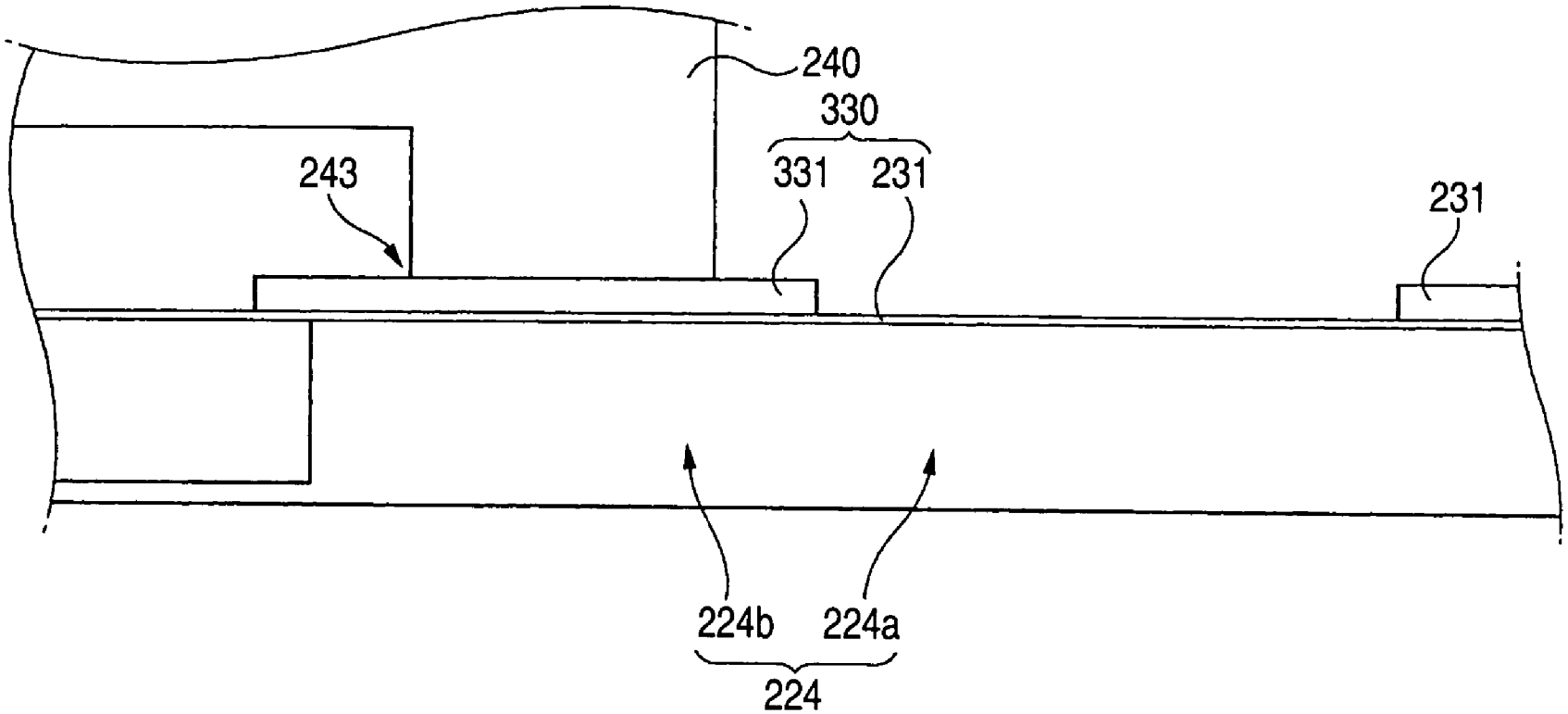
FIG. 14 is a schematic sectional view taken on line F-F' in FIG. 13.

FIG. 13 is a schematic plan view to show a part of joint positions of a head case, a SUS thin film, a PPS film, and partition walls of a recording head of an ink jet record apparatus according to a sixth embodiment of the invention. FIG. 14 is a schematic sectional view taken on line F-F' in FIG. 13.

The ink jet record apparatus of the embodiment has a roughly similar configuration to that of the ink jet record apparatus 100 according to the first embodiment described above and therefore components identical with those previously described with reference to the accompanying drawings are denoted by the same reference numerals and will not be discussed again and a description will be given centering around the difference.

As shown in FIG. 13, the SUS thin film 331 of the sealing plate 330 is formed on the ink supply passage 222 side, the lower side in the figure, and the SUS thin film 331 of the sealing plate 330 in the head case placement area 243 is formed like comb teeth.

Further, above the ink supply passage partition wall 224*b* in the head case placement area 243, the SUS thin film 331 is placed with a smaller width than the width above the ink supply passage partition wall 224*b*.

Specifically, the SUS thin film 331 is formed longer than is wide in the length direction (longitudinal direction in FIG. 13) of the ink supply passage partition wall 224*b* as shown in FIG. 13.

That is, width W2 of the SUS thin film 331 above the ink supply passage partition wall 224*b* shown in FIG. 13 is formed smaller than width W1 of the ink supply passage partition wall 224*b* (70 μm) by about 20 μm. Therefore, the area of the SUS thin film 331 on the ink supply passage partition wall 224*b* is formed small as compared with the area of the ink supply passage partition wall 224*b*.

In the above configuration, if the head case 240 is bonded to the flow passage board 220 through the sealing plate 330 in a situation in which the head case 240 and the flow passage board 220 differ in linear expansion coefficient as described above, the following occurs:

If the head case 240 and the ink supply passage partition wall 224*b* shown in FIG. 14 differ in expansion coefficient in the head case placement area 243 in FIG. 13, stress of distortion occurs in the sealing plate 330 placed between the head case 240 and the ink supply passage partition wall 224*b*.

At this time, the adhesive force between the PPS film 232 and the ink supply passage partition wall 224*b* is the weakest in the sealing plate 330 immersed in ink and thus the bond part between the PPS film 232 and the ink supply passage partition wall 224*b* in the sealing plate 330 is easily affected by distortion based on the expansion coefficient difference between the head case 240 and the flow passage board, and force easily works in the peeling direction between the PPS film 232 and the ink supply passage partition wall 224*b* just below the head case 240 in FIG. 14.

In this point, in the embodiment, the SUS thin film is divided like comb teeth as shown in FIG. 13 and has thickness, so that the distortion amount caused by the difference between the linear expansion coefficients can be suppressed. Thus, the force is relieved in the bend direction of the SUS thin film 331 and applying the force between the PPS film 232 and the ink supply passage partition wall 224*b* can be relieved.

That is, the SUS thin film 331 is placed in the portion joined to the corresponding ink supply passage partition wall 224*b* with the PPS film 232 and space exists between the SUS thin film 331 joined to the ink supply passage partition wall 224*b* and the adjacent SUS thin film 331 joined to the adjacent ink supply passage partition wall 224*b*.

Accordingly, if the head case 240 and the ink supply passage partition wall 224*b* differ in expansion coefficient the distortion acts on the bond width and thickness is provided, so that the force is also escaped in the falling direction. Thus, concentration of the force between the PPS film 232 and the ink supply passage partition wall 224*b* can be relieved as compared with the case where the SUS thin film 331 is formed continuously.

Thus, it becomes hard for the distortion to largely act on between the PPS film 232 and the ink supply passage partition wall 224*b*, and the PPS film 232 and the ink supply passage partition wall 224*b* become hard to peel.

Therefore, unlike the record head in the related art, peeling of the sealing plate 330 above the ink supply passage partition wall 224*b* caused by the expansion coefficient difference becomes harder to occur. Accordingly, ink can be prevented from getting over the ink supply passage partition wall 224*b* and leaking from the ink supply passage 222*a* in FIG. 13, for example, to the ink supply passage 222*b*, so that the ink jet record apparatus 100 having the record head 200 wherein a failure is hard to occur can be provided.

Since the SUS thin film 331 in the head case placement area 243 is placed along the length direction of the ink supply passage partition wall 224*b* as shown in FIG. 13, the head case 240 in FIG. 3 can be strongly fixedly secured and held.

Therefore, the sealing plate 330 provided on the ink supply passage partition wall 224*b* can be prevented from peeling and the head case 240 can be strongly fixedly secured at the same time.

Seventh Embodiment

Figure 15:
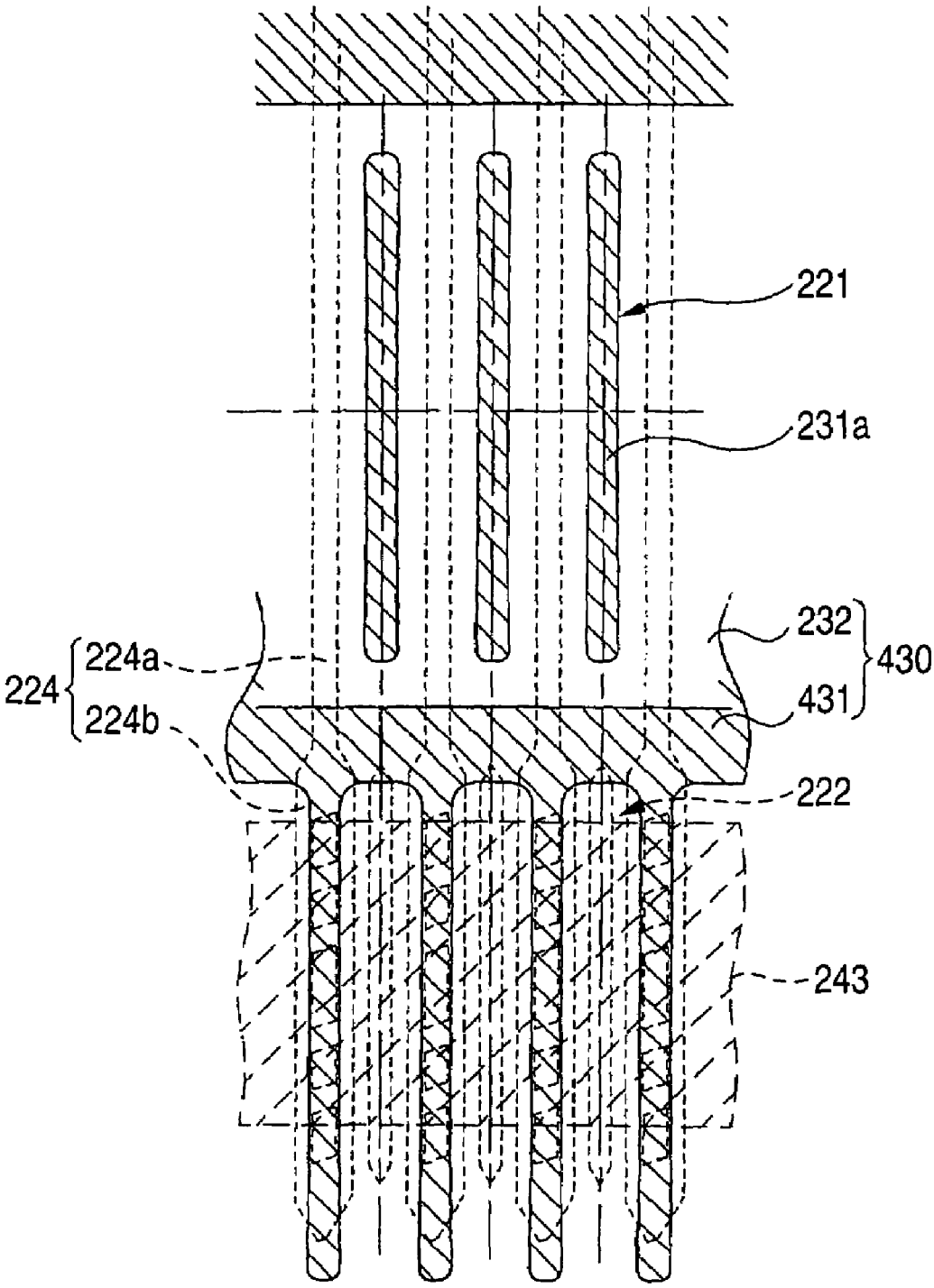
FIG. 15 is a schematic plan view to show the main part of a record head of an ink jet record apparatus of a seventh embodiment of the invention.

FIG. 15 is a schematic plan view to show the main part of a record head of an ink jet record apparatus of a seventh embodiment of the invention.

The ink jet record apparatus of the embodiment has a roughly similar configuration to that of the ink jet record apparatus 100 according to the sixth embodiment described above and therefore components identical with those previously described with reference to the accompanying drawings are denoted by the same reference numerals in FIG. 15 and will not be discussed again and a description will be given centering around the difference.

As shown in FIG. 15, in the second embodiment, unlike the SUS thin film 331 of the record head 200 of the sixth embodiment previously described with reference to FIG. 13, only a PPS film 331 of a transparent portion in FIG. 15 is placed on a sealing plate 430 corresponding to ink supply passages 222 in a head case placement area 243, and no SUS thin film 431 is placed.

Therefore, the bond area of a SUS thin film 431 of the sealing plate 430 in an ink supply passage partition wall 224*b* and a head case 240 is furthermore lessened as compared with that in the sixth embodiment, so that peeling of the PPS film 232 and the ink supply passage partition wall 224*b* can be made harder to occur.

Eighth Embodiment

Figure 16:
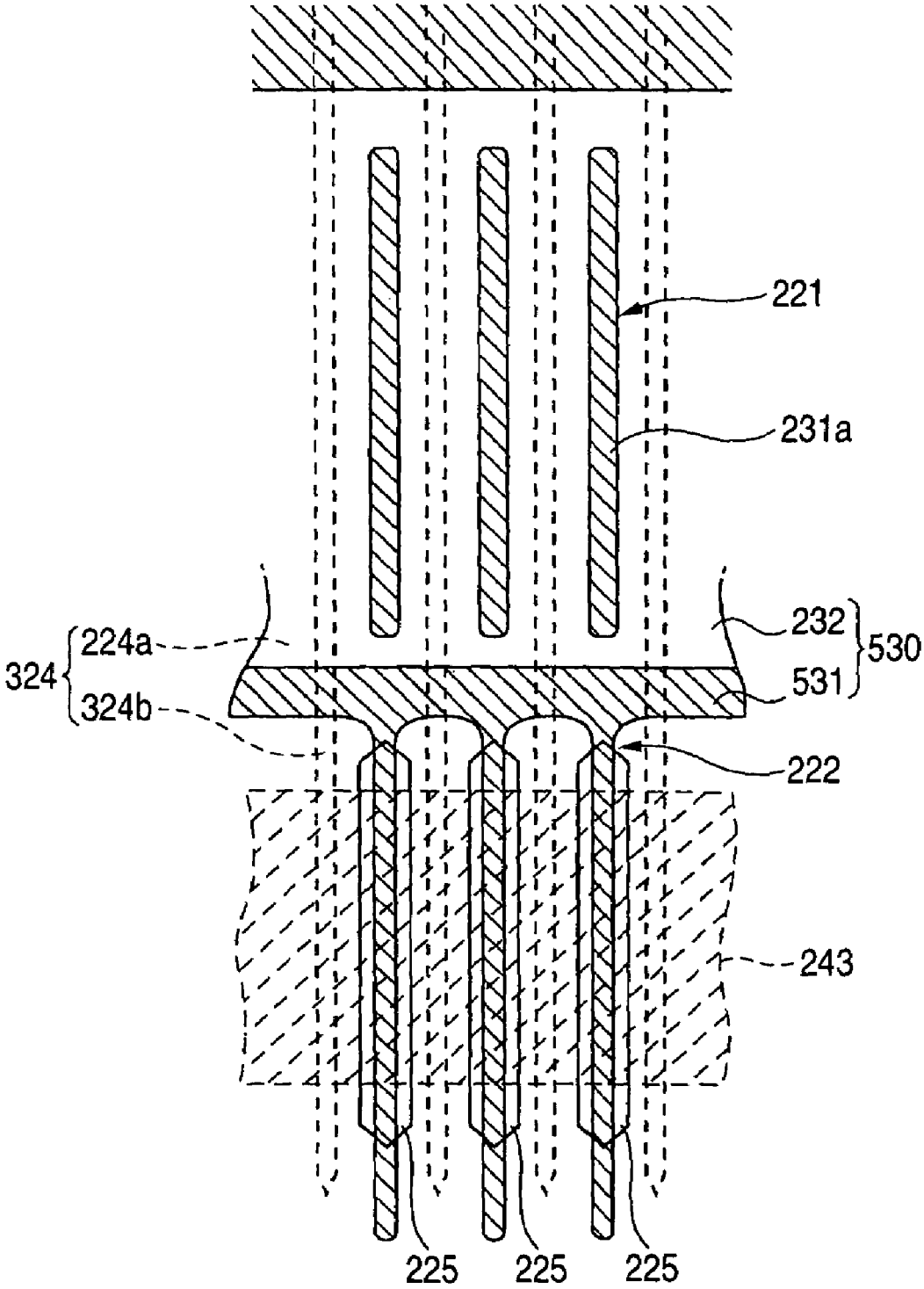
FIG. 16 is a schematic plan view to show the main part of a record head of an ink jet record apparatus according to a eighth embodiment of the invention.

FIG. 16 is a schematic plan view to show the main part of a record head of an ink jet record apparatus of a eighth embodiment of the invention.

The ink jet record apparatus of the embodiment has a roughly similar configuration to that of the ink jet record apparatus 100 according to the sixth embodiment described above and therefore components identical with those previously described with reference to the accompanying drawings are denoted by the same reference numerals in FIG. 16 and will not be discussed again and a description will be given centering around the difference.

In the eighth embodiment unlike the sixth embodiment, a SUS thin film 531 is formed on a sealing plate 530 corresponding to island-like projections 225 of ink supply passages 222 in a head case placement area 243, as shown in FIG. 16.

The width of the SUS thin film 531 formed corresponding to each of the island-like projections 225 is narrower than the width of the island-like projection 225, as shown in FIG. 16.

No SUS thin film 531 is formed on the sealing plate 530 corresponding to ink supply passage partition walls 324*b*, and only a PPS film 232 represented transparently in FIG. 16 is placed.

Thus, the SUS thin film 531 is always placed in the portion joined to the corresponding island-like projections 225 and space exists between the SUS thin film 431 above each island-like projection 225 and the adjacent one.

Accordingly, if a head case 240 and the island-like projection 225 differ in expansion coefficient, the distortion acts on the bond width.

Since the SUS thin film 631 is thick, the force is also soaped in the falling direction of the SUS thin film 531, and concentration of the force between PPS film 232 and the island-like projection 225 can be relieved as compared with the case where the SUS thin film 531 is formed continuously.

Therefore, it becomes hard for the distortion to largely act on between PPS film 232 and the island-like projection 225, and both become hard to peel.

The record head is provided wherein a failure caused by ink leakage beyond the ink supply passage partition wall 324*b* is hard to occur.

Ninth Embodiment

Figure 17:
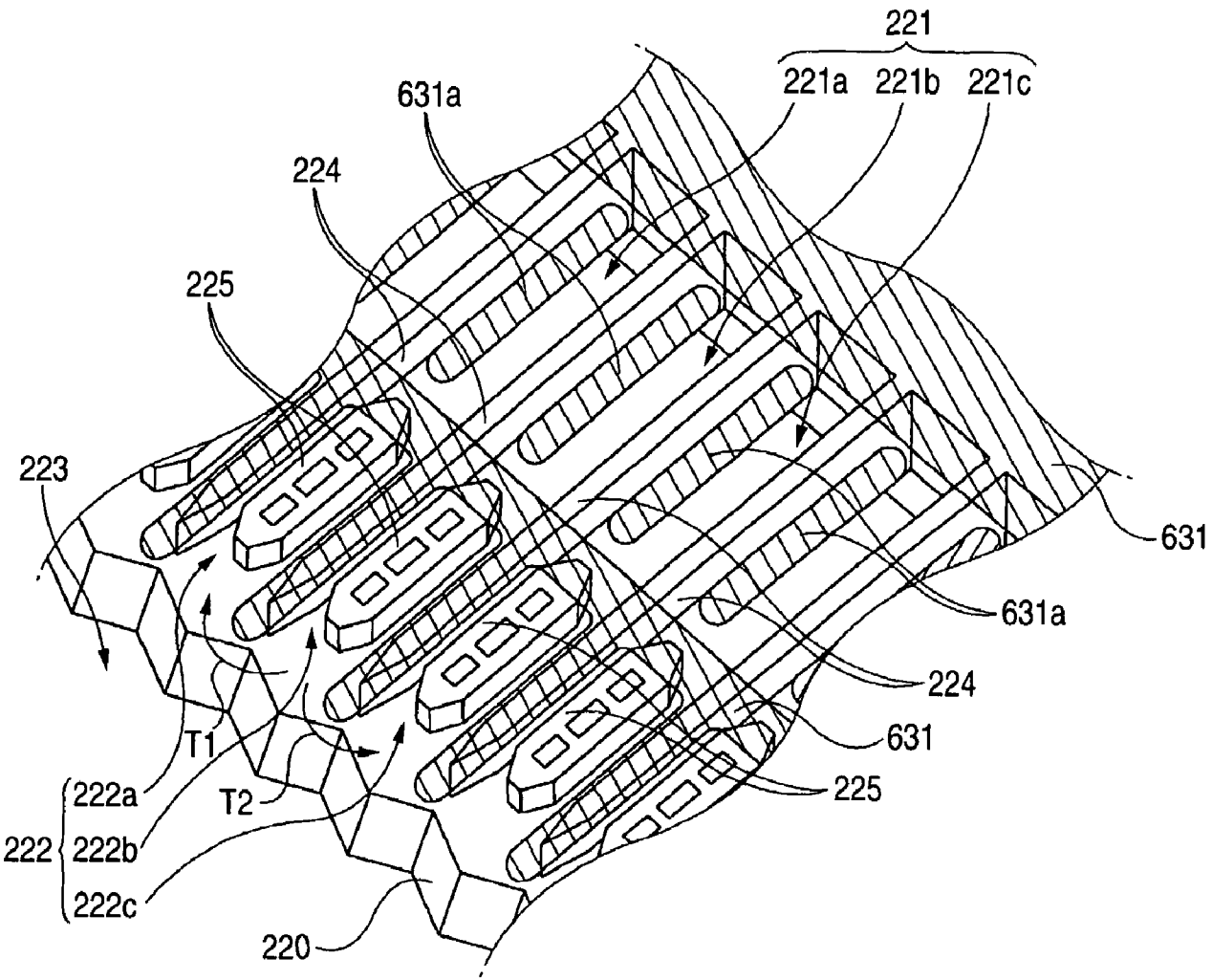
FIG. 17 is a schematic enlarged representation to show a flow passage board, a sealing plate, etc., of a record head of an ink jet record apparatus according to a ninth embodiment of the invention.
Figure 18:
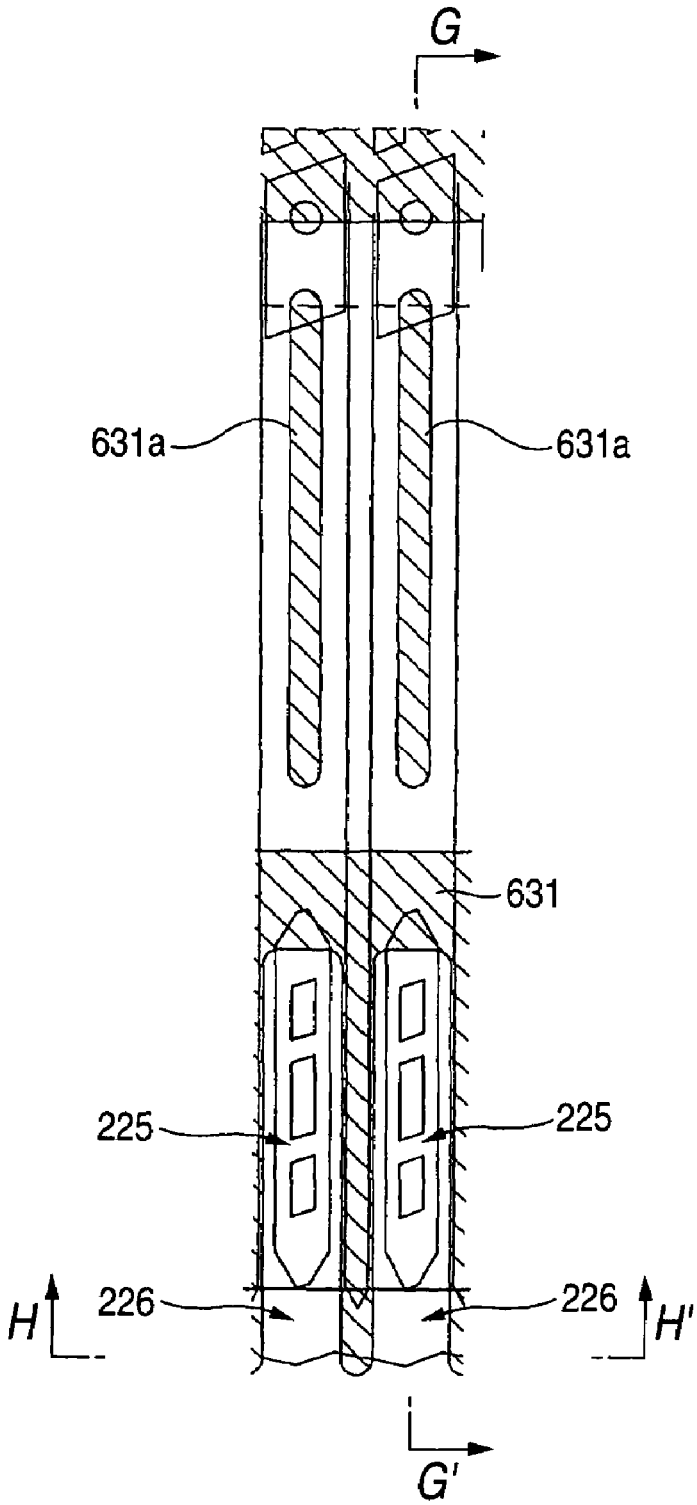
FIG. 18 is a schematic plan view of a part in FIG. 17.

FIG. 17 is a schematic enlarged representation to show a flow passage board 220, a sealing plate 630, etc., of a record head of an ink jet record apparatus according to a ninth embodiment of the invention. FIG. 18 is a schematic plan view of a part in FIG. 17.

The ink jet record apparatus of the embodiment has a roughly similar configuration to that of the ink jet record apparatus 100 according to the first embodiment described above and therefore components identical with those previously described with reference to the accompanying drawings are denoted by the same reference numerals and will not be discussed again and a description will be given centering around the difference.

As shown in FIG. 17, the pressure generation chambers 221 provided in a one-to-one correspondence with the nozzle openings 211 of the nozzle plate 210 are paired with the ink supply passages 222 on the flow passage board 220. Partition walls 224, for example, of partition wall parts for separating the ink supply passages 222 and the pressure generation chambers 221 prevent ink from flowing from one into another.

Since each pressure generation chamber 221 communicates with its corresponding ink supply passage 222 as shown in FIG. 17, pressure produced in the pressure generation chamber 221 escapes to the ink supply passage 222.

Then, each ink supply passage 222 is formed with a pressure island part 225, for example, of a pressure reduction prevention part for preventing a reduction in the pressure in the pressure generation chamber 221 as shown in FIG. 17.

The ink flow in the ink supply passage 222 is further narrowed in the presence of the pressure island part 225 and a reduction in the pressure in the pressure generation chamber 221 can be prevented.

The PPS film 232 of the sealing plate 630 is fixedly secured with an adhesive, etc., above the partition walls 224 in FIG. 17. The PPS film 232 is shown transparently in FIG. 17.

The SUS thin film 631 deposited on the PPS film 232 is etched to a predetermined shape; in FIG. 17, the etched portion is shown transparently and the remaining portion is hatched.

The hatched remaining parts of the SUS thin film 631 formed like ellipses corresponding to the pressure generation chambers 221 are the island parts 631*a*, which are fixedly secured to the front end parts of the piezoelectric vibrators 250 for applying pressure to the pressure generation chambers 221 as the piezoelectric vibrators 250 are expanded.

A portion wherein the SUS thin film 631 is not formed is formed in the portion corresponding to each ink supply passage 222, and the SUS thin film 631 is formed in the portion corresponding to the partition walls 224.

That is, a portion wherein the SUS thin film 631 is not formed is formed like comb teeth in the ink supply passage 222 direction from the ink reservoir 223 side in FIGS. 17 and 18. The PPS film 232 is formed in the portion wherein the SUS thin film 631 is not formed and is bonded to the pressure island parts 225 in FIG. 18.

Compliance parts 226 are provided in the portion formed only with the PPS film 232 and not bonded to the pressure island parts 225, at the bottom in the figure.

Each compliance part 226 shown in FIG. 18 is not formed with the SUS thin film 631 and is made of only the PPS film 232 as described above and the PPS film 232 has lower rigidity than the SUS thin film 631 and the compliance part 226 (PPS film 232) is not bonded to the pressure island part 225. Thus, the compliance part 226 has an easily deformable structure by pressure in the ink supply passage 222.

That is, one example of pressure release part formed on the sealing plate 630 corresponding to the ink supply passage 222 is the compliance part 226.

Figure 19:
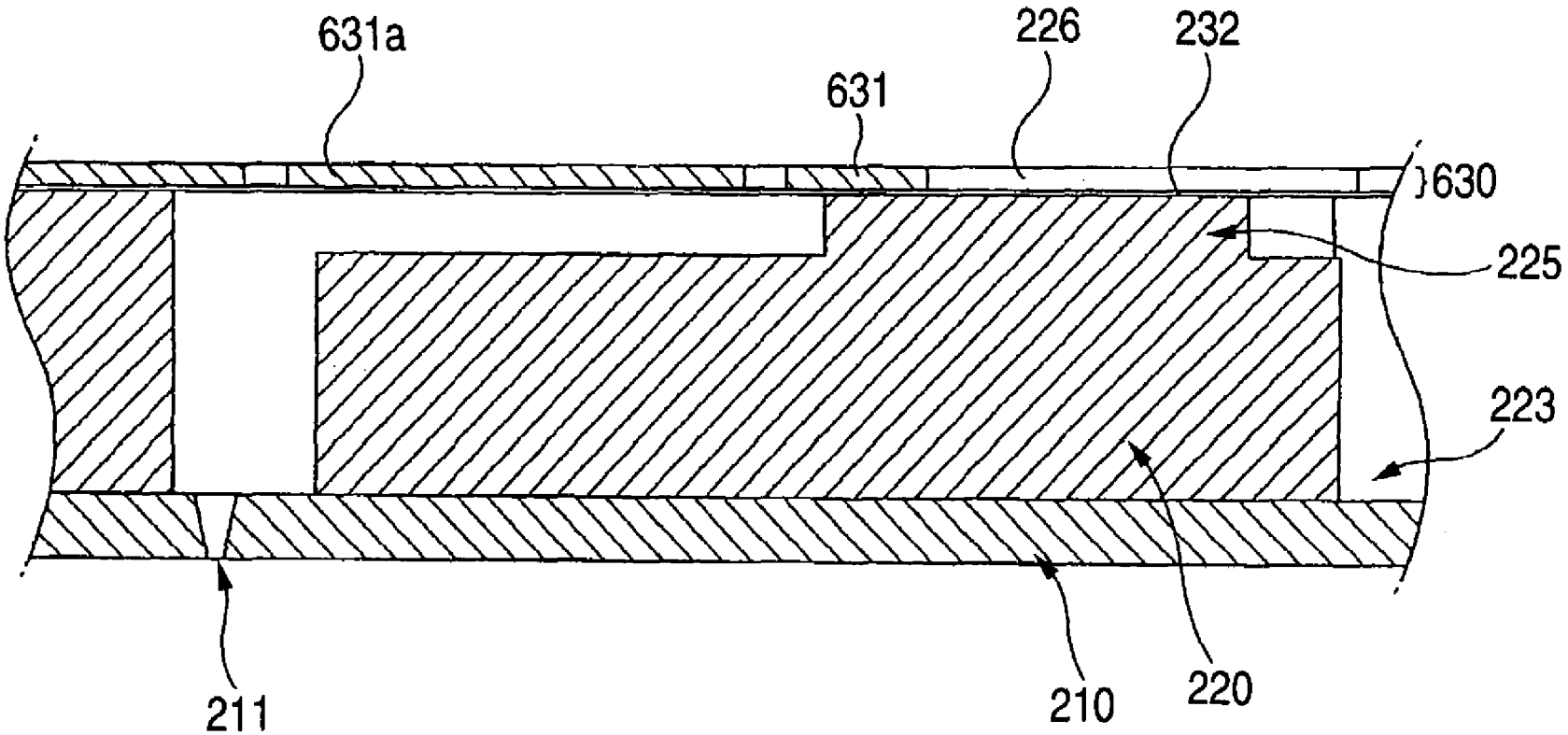
FIG. 19 is a schematic sectional view taken on line G-G' in FIG. 18.
Figure 20:
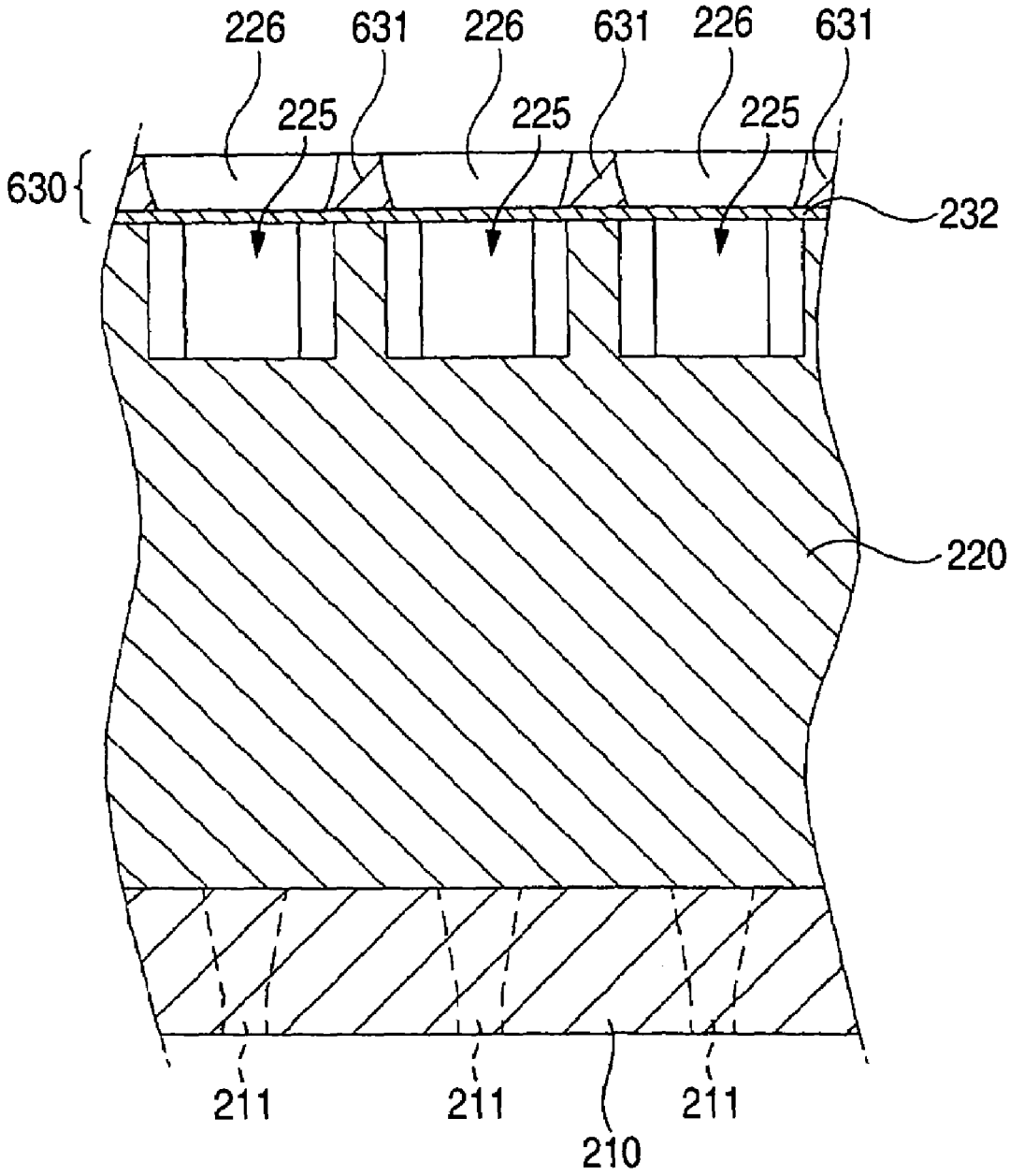
FIG. 20 is a schematic sectional view taken on line H-H' in FIG. 18.

FIG. 19 is a schematic sectional view taken on line G-G' in FIG. 18. FIG. 20 is a schematic sectional view taken on line H-H' in FIG. 18.

It is seen in FIGS. 19 and 20 that the sealing plate 630 becomes remarkably thin in the portion wherein each compliance part 226 is formed and the portion is made of the PPS film 232 only and thus is of an easily deformable structure by pressure in the ink supply passage 222.

For convenience, let the pressure generation chamber 221 at the left of FIG. 17 be first pressure generation chamber 221*a* and the ink supply passage 222 communicating with the first pressure generation chamber 221*a* be first ink supply passage 222*a*.

Likewise, let the right adjacent pressure generation chamber 221 via the partition wall 224 be second pressure generation chamber 221*b* and the ink supply passage 222 communicating with the second pressure generation chamber 221*b* be second ink supply passage 222*b*. Further, let the adjacent pressure generation chamber 221 be third pressure generation chamber 221*c* and the ink supply passage 222 communicating with the third pressure generation chamber 221*c* be third ink supply passage 222*c*.

When the piezoelectric vibrator 250, etc., is expanded and presses the second pressure generation chamber 221*b* in FIG. 17, if the pressure acts so as to push ink in the second ink supply passage 222*b* into the ink reservoir 223 side, the pressure is released as the PPS film 232 of the compliance part 226 provided corresponding to the second ink supply passage 222*b* deforms toward the top of FIG. 17.

Thus, the pressure is prevented from propagating through the adjacent first ink supply passage 222*a* or third ink supply passage 222*c* and acting on the first pressure generation chamber 221*a* or the third pressure generation chamber 221*c* as indicted by arrow T1 or T2 in FIG. 17.

Therefore, crosstalk to erroneously eject ink from the nozzle opening 211 (see FIG. 19) corresponding to the first pressure generation chamber 221*a* or the third pressure generation chamber 221*c* can be prevented.

Thus, the compliance parts 226 can be easily formed as the SUS thin film 631 is removed by etching, etc., so that the compliance parts 226 can be formed at remarkably low cost.

By the way, the SUS thin film 631 of the sealing plate 630 is placed without being etched in the portion corresponding to the partition wall 224, as shown in FIG. 17.

The partition wall 224 acts so as to prevent crosstalk to eject ink from a different nozzle opening 211. Thus, if peeling occurs between the partition wall 224 and the sealing plate 630 and ink leaks beyond the partition wall 224, the ink leakage is directly linked to a failure of the record head 200. Thus, it is desirable that peeling should be made hard to occur between the partition wall 224 and the sealing plate 630 as much as possible.

In this point, in the embodiment, when the sealing plate 630 is bonded and fixed to the head case 240, the partition wall 224 is bonded to the head case 240 via the SUS thin film 631, etc. Therefore, peeling is especially hard to occur as compared with the case where the partition wall 224 is bonded only with the PPS film 232.

Each ink supply passage 222 in FIG. 17 is formed with the pressure island part 225 to prevent pressure leakage in the pressure generation chamber 221, as described above. Thus, if the sealing plate 630 corresponding to the pressure island part 225 at least on the pressure generation chamber 221 side of the pressure island part 225, namely, the boundary with the pressure generation chamber 221 is formed of the PPS film 232 only, pressure in the pressure generation chamber 221 is released as the PPS film 232 deforms.

Thus, the compliance parts 226 are not formed in the whole of the portions corresponding to the pressure island parts 225, as shown in FIGS. 17 and 18. The SUS thin film 631 is consciously left and placed in the portion of the sealing plate 630 corresponding to the portion of each pressure island part 225 playing a role preventing relief of pressure in the pressure generation chamber 221 in the boundary between the pressure generation chamber 221 and the ink supply passage 222.

Therefore, the rigidity of the sealing plate 630 in the boundary is enhanced, so that pressure relief in the pressure generation chamber 221 is prevented effectively and a pressure failure in the pressure generation chamber 221 is also made hard to occur.

First Modification of the Ninth Embodiment

Figure 21:
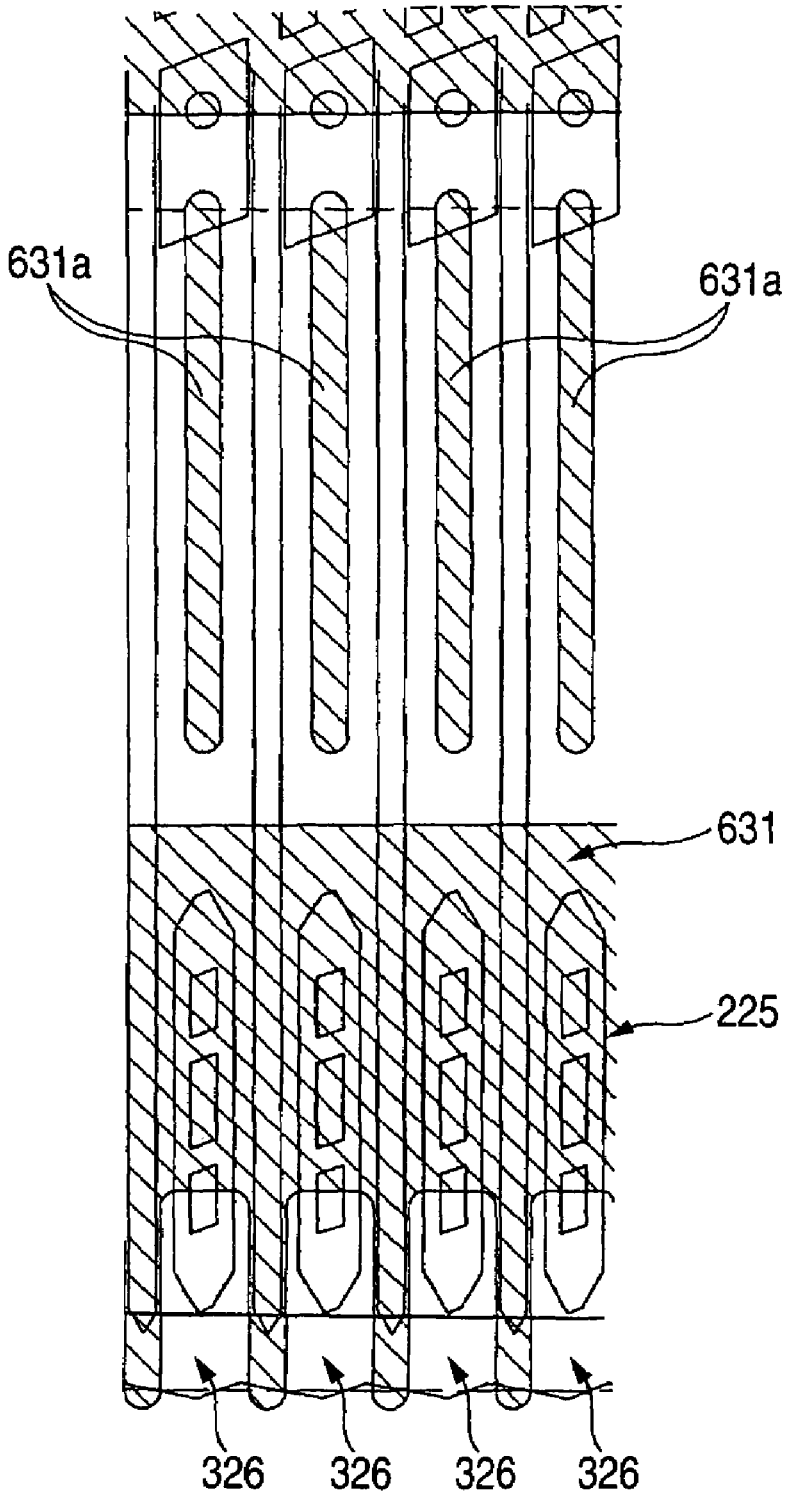
FIG. 21 is a schematic plan view to show the main part of a first modification of the record head of the ink jet record apparatus according a first modification of the ninth embodiment of the invention.

FIG. 21 is a schematic plan view to show the main part of a first modification of the record head 200 of the ink jet record apparatus 100 of the ninth embodiment.

The ink jet record apparatus of the modification has a roughly similar configuration to that of the ink jet record apparatus 100 according to the ninth embodiment described above and therefore components identical with those previously described with reference to the accompanying drawings are denoted by the same reference numerals in FIG. 21 and will not be discussed again and a description will be given centering around the difference.

As shown in FIG. 21, in the modification, unlike the compliance part 226 of the record head 200 of the embodiment previously described with reference to FIG. 18, each compliance part 326 is provided small.

Thus, as for the portion of a sealing plate 630 corresponding to each pressure island part 225, a SUS thin film 631 is formed in a wider area than that in the record head 200 of the ninth embodiment described above.

Therefore, a pressure failure of a pressure generation chamber 221 communicating with an ink supply passage 222 can be prevented more reliably.

Second Modification of the Ninth Embodiment

Figure 22:
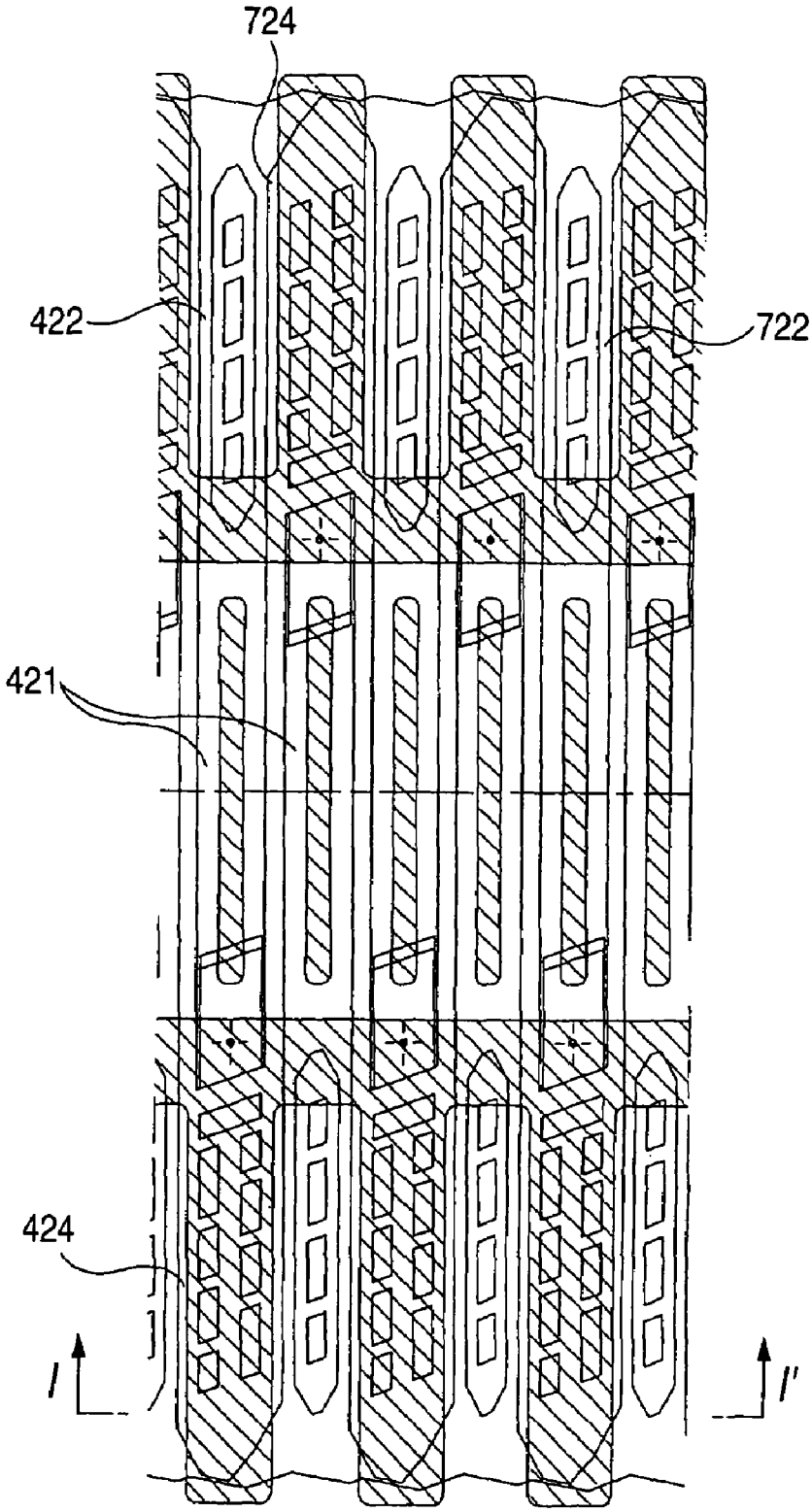
FIG. 22 is a schematic plan view to show the main part of a second modification of the ninth embodiment of the invention.
Figure 23:
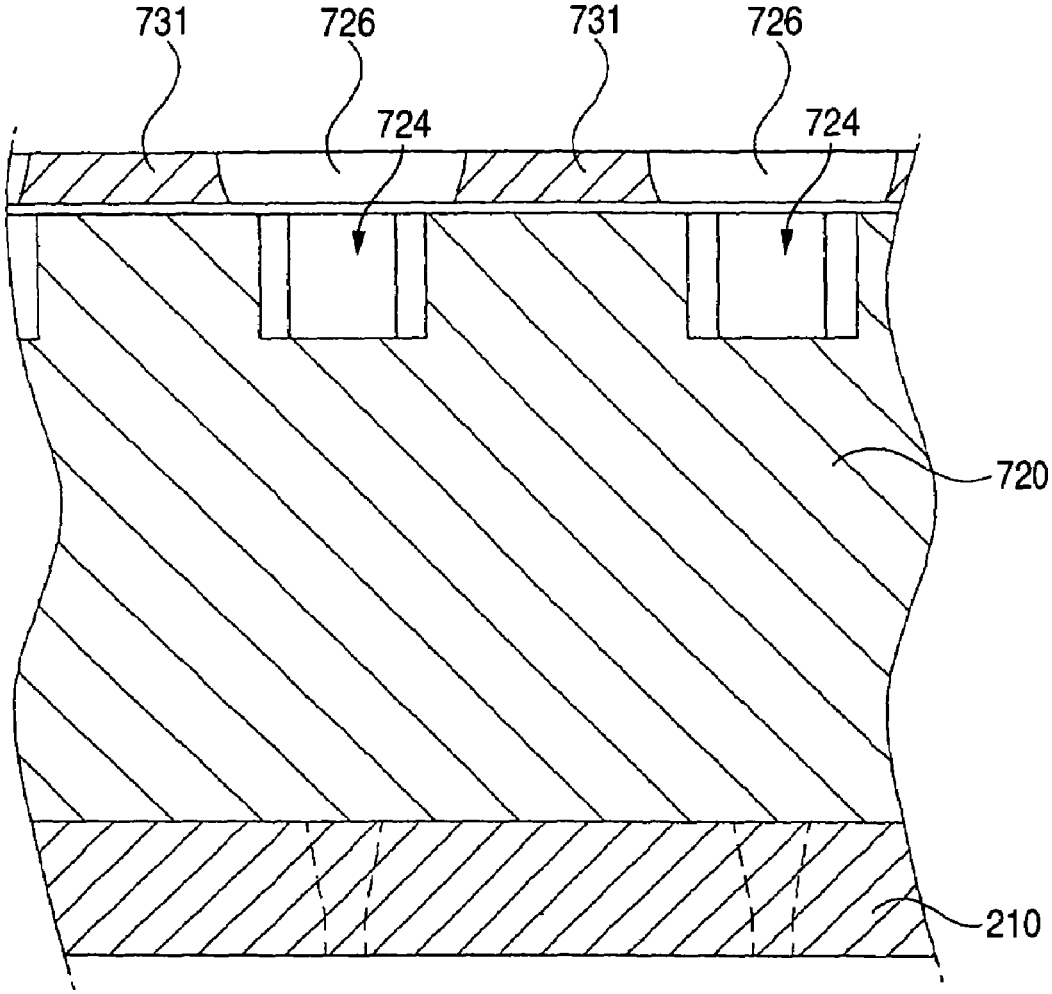
FIG. 23 is a schematic sectional view taken on line I-I' in FIG. 22.
Figure 24:
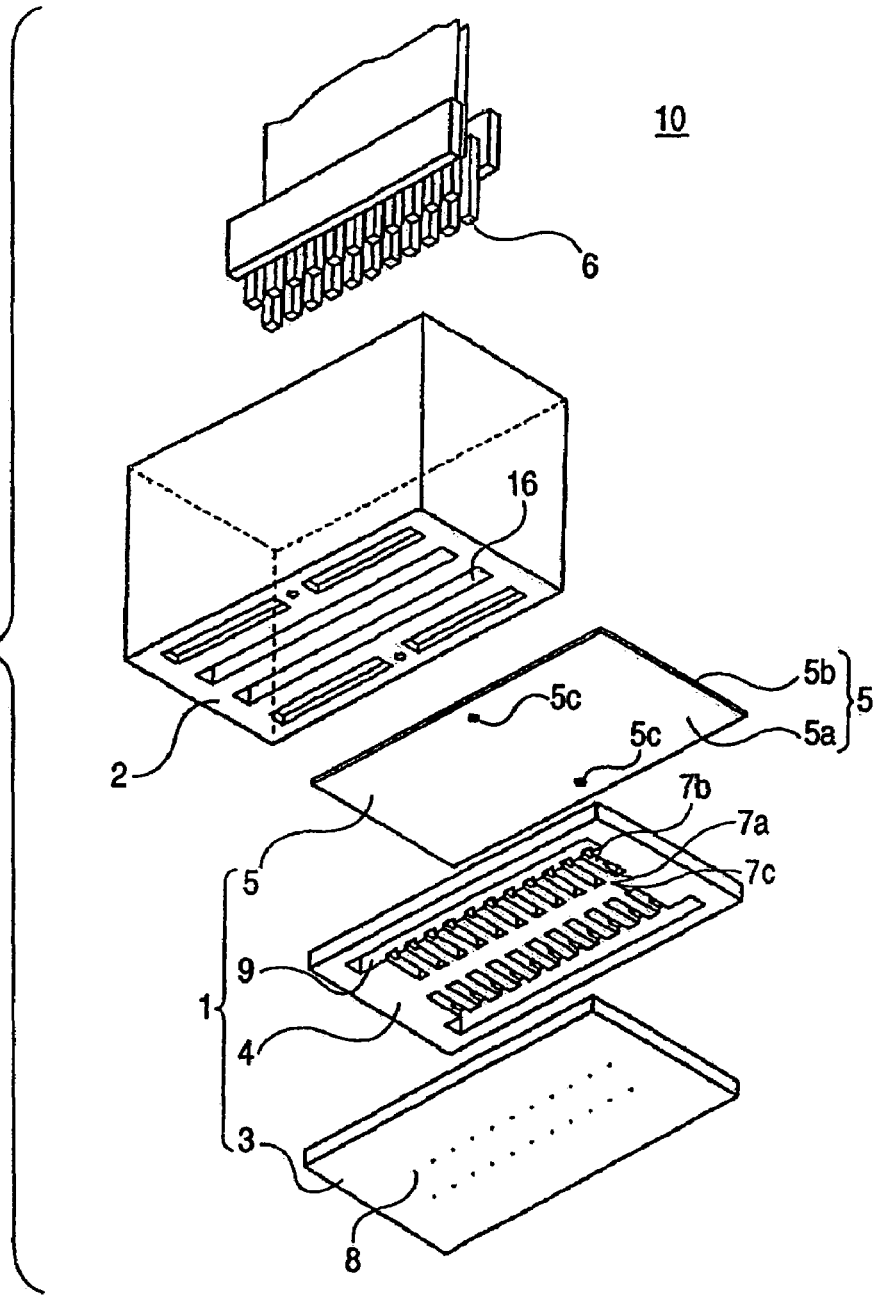
FIG. 24 PRIOR ART
FIG. 24 is a schematic exploded perspective view to show the first related record head.
Figure 25:
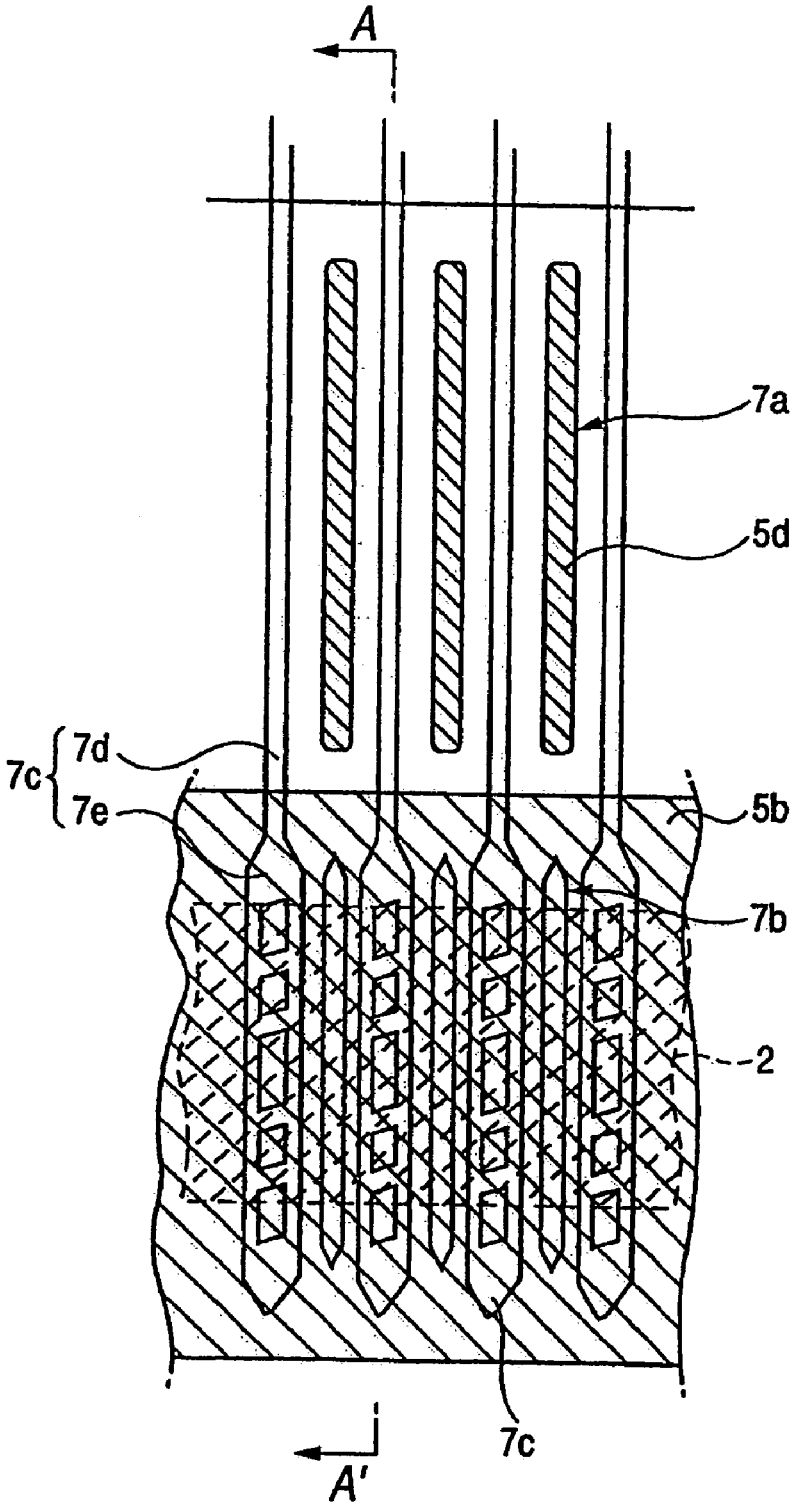
FIG. 25 PRIOR ART
FIG. 25 is a schematic representation to show a state in which a sealing plate is bonded, etc., above pressure generation chambers and ink supply passages formed like comb teeth and further a head case is bonded above them.
Figure 26:
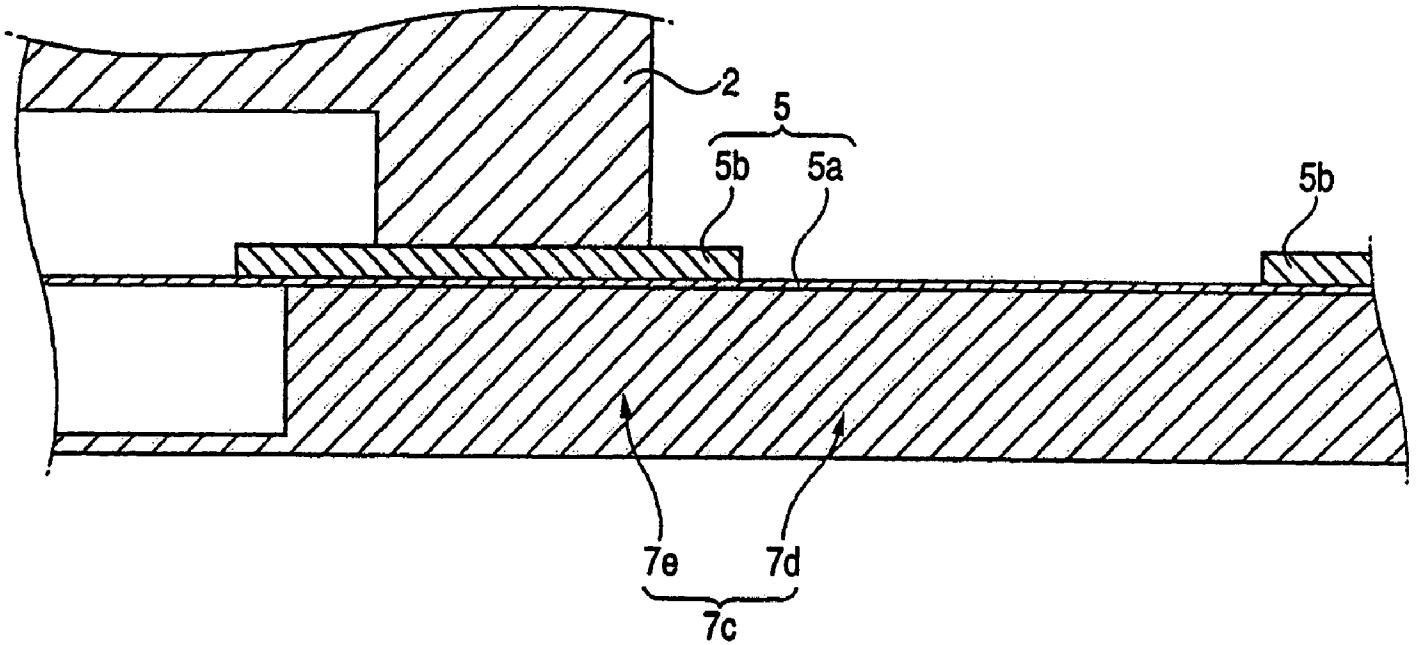
PRIOR ART FIG. 26
FIG. 26 is a schematic sectional view taken on line A-A' in FIG. 25.
Figure 27:
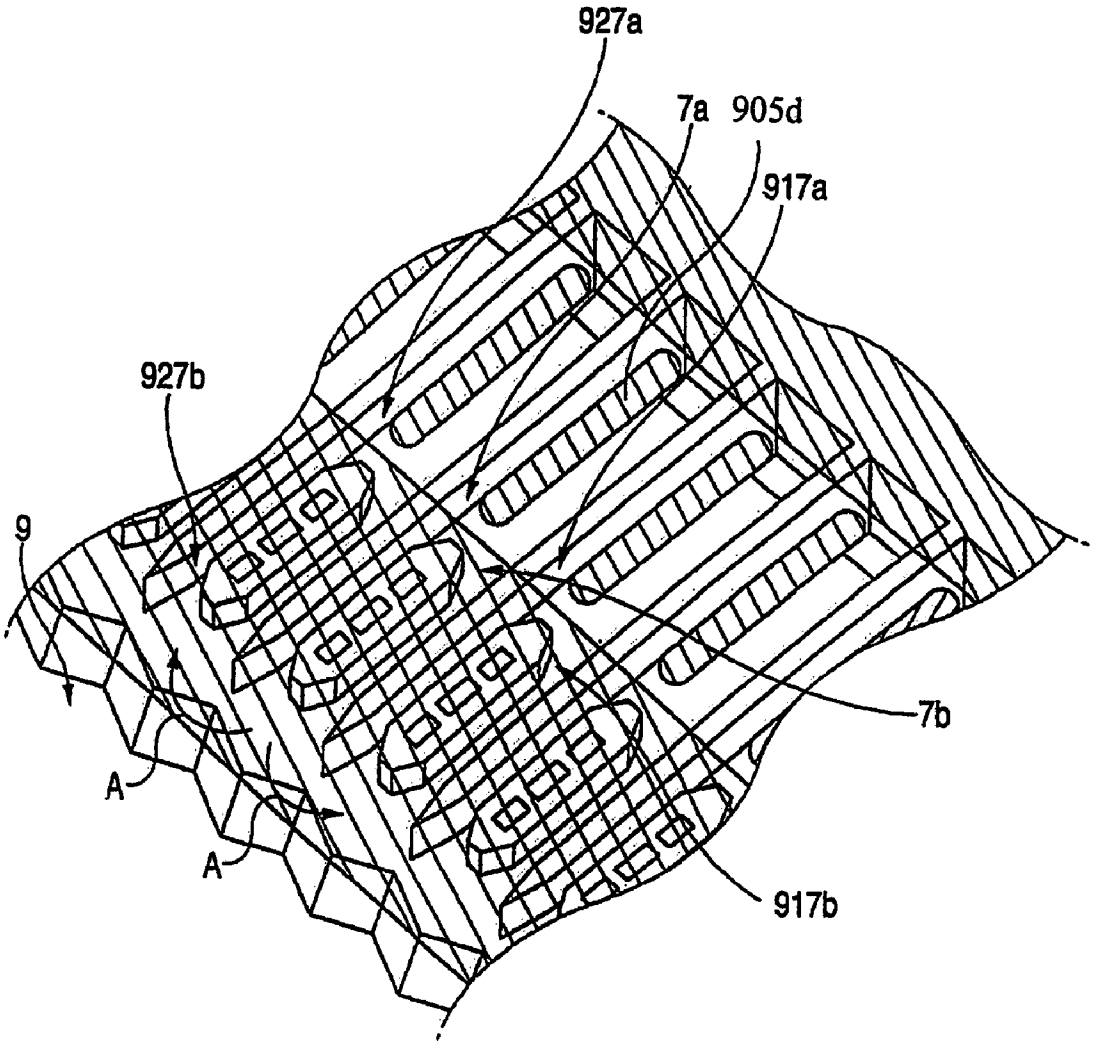
PRIOR ART FIG. 27
FIG. 27 is a schematic representation to show the relationship between pressure generation chambers and ink supply passages formed like comb teeth and a metal thin film of a sealing plate in the second related art.
Figure 28:
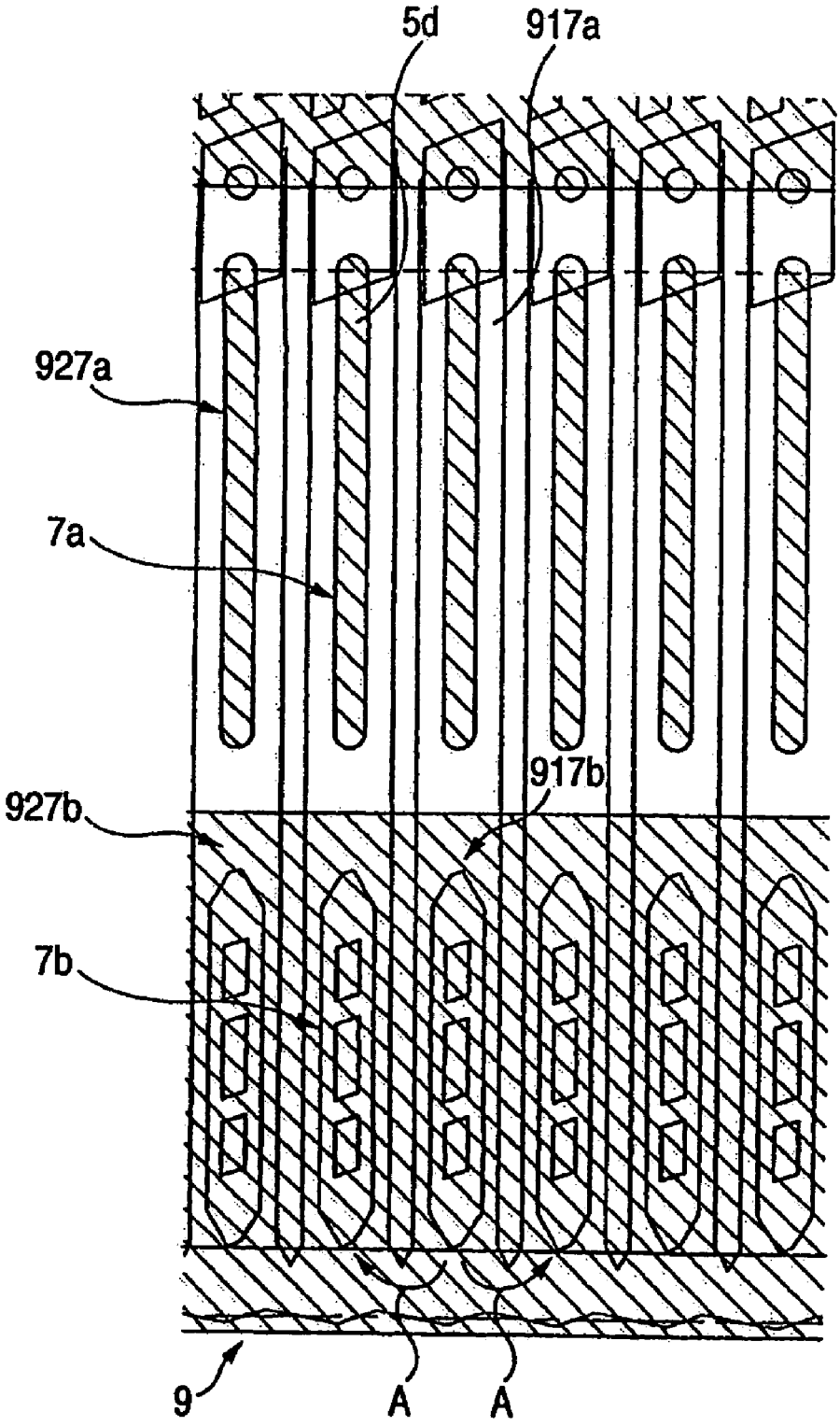
FIG. 28 PRIOR ART
FIG. 28 is a schematic plan view to show the relationship between the pressure generation chambers and the ink supply passages and the metal thin film of the sealing plate in the second related art in FIG. 27.

FIG. 22 is a schematic plan view to show the main part of a second modification of the ninth embodiment. FIG. 23 is a schematic sectional view taken on line I-I' in FIG. 22.

The ink jet record apparatus of the modification has a roughly similar configuration to that of the ink jet record apparatus 100 according to the ninth embodiment described above and therefore components identical with those previously described with reference to the accompanying drawings are denoted by the same reference numerals and will not be discussed again and a description will be given centering around the difference.

Ink supply passages 722 formed on a flow passage board 720 of the modification are placed alternately on both sides with a pressure generation chamber 721 between, namely, are staggered. Partition walls 724 are also staggered.

Even on the flow passage board 720 thus formed, compliance parts 726, a SUS thin film 731, etc., can be placed as shown in FIG. 23, and advantages similar to those of the record head 200 and the ink jet record apparatus 100 according to the ninth embodiment described above can be provided.

The invention is not limited to the specific embodiments described above. Further, the above-described embodiments may be formed in combination.

What is claimed is:

1. A liquid ejecting head comprising: a flow passage formation section including:

a plurality of nozzle openings, ejecting liquid therefrom;

a plurality of pressure generation parts, corresponding to the nozzle openings respectively;

a plurality of liquid supply passages, communicating with the pressure generation parts respectively for supplying liquid thereto; and a plurality of partition wall parts, each separating one liquid supply passage and its corresponding pressure generation part from another liquid supply passage and its corresponding pressure generation part;

a sealing section, sealing the flow passage formation section; and a head case section, provided on the sealing section, wherein the partition wall parts respectively include liquid supply passage partition wall parts which separate adjacent liquid supply passages;

wherein the sealing section seals an area of the flow passage formation section corresponding to both the liquid supply passage partition wall parts and the liquid supply passage of the flow passage formation section, and the sealing section has a first area and a second area being greater in thickness than the first area;

wherein both the first area and the second area are opposed to the liquid supply passage;

wherein the head case section is separated by a vacancy from the sealing section at the first area opposed to the liquid supply passage;

wherein the sealing section has a first part and a second part being greater in thickness than the first part;

wherein the first area of the sealing section is formed with the first part;

wherein the second area of the sealing section is formed with the first part and the second part;

wherein the head case section, provided on the flow passage formation section through the sealing section, has an expansion coefficient different from that of the flow passage formation section;

wherein the second part inside of the area where the head case section is provided on the sealing section is placed in a part of each of the liquid supply passage partition wall parts;

wherein the second part has a first portion and a second portion which are separated from each other;

wherein the first portion of the second part is placed only on a base side close to the pressure generation parts in the liquid supply passage partition wall parts;

wherein the second portion of the second part is placed only on a tip side away from the pressure generation parts in the liquid supply passage partition wall parts; and wherein a reinforcement member not contributing to expansion is placed in an intermediate part between the tip side and the base side of the liquid supply passage partition wall parts.

2. A liquid ejecting head, comprising: a flow passage formation section including:

a plurality of nozzle openings, ejecting liquid therefrom;

a plurality of pressure generation parts, corresponding to the nozzle openings respectively;

a plurality of liquid supply passages, communicating with the pressure generation parts respectively for supplying liquid thereto; and a plurality of partition wall parts, each separating one liquid supply passage and its corresponding pressure generation part from another liquid supply passage and its corresponding pressure generation part;

a sealing section, sealing the flow passage formation section; and a head case section, provided on the sealing section, wherein the partition wall parts respectively include liquid supply passage partition wall parts which separate adjacent liquid supply passages;

wherein the sealing section seals an area of the flow passage formation section corresponding to both the liquid supply passage partition wall parts and the liquid supply passage of the flow passage formation section, and the sealing section has a first area and a second area being greater in thickness than the first area;

wherein both the first area and the second area are opposed to the liquid supply passage;

wherein the head case section is separated by a vacancy from the sealing section at the first area opposed to the liquid supply passage;

wherein the sealing section has a first part and a second part being greater in thickness than the first part;

wherein the first area of the sealing section is formed with the first part;

wherein the second area of the sealing section is formed with the first part and the second part;

wherein the head case section, provided on the flow passage formation section through the sealing section, has an expansion coefficient different from that of the flow passage formation section;

wherein the second part is placed in the liquid supply passage partition wall parts; and wherein the second part to which the head case section is joined has a width smaller than a width of the corresponding liquid supply passage partition wall part.

3. The liquid ejection head as set forth in claim 2, wherein the second part is provided along a longitudinal direction of each of the liquid supply passage partition wall parts.

4. The liquid ejection head as set forth in claim 2, wherein the sealing section corresponding to a portion where the head case section is placed and the liquid supply passage is placed, is formed with the first part only; and wherein the second part of the sealing section in the portion where the head case section is placed is formed like comb teeth.

5. A liquid ejecting head, comprising: a flow passage formation section including:

a plurality of nozzle openings, ejecting liquid therefrom;

a plurality of pressure generation parts, corresponding to the nozzle openings respectively;

a plurality of liquid supply passages, communicating with the pressure generation parts respectively for supplying liquid thereto; and a plurality of partition wall parts, each separating one liquid supply passage and its corresponding pressure generation part from another liquid supply passage and its corresponding pressure generation part;

a sealing section, sealing the flow passage formation section; and a head case section, provided on the sealing section, wherein the partition wall parts respectively include liquid supply passage partition wall parts which separate adjacent liquid supply passages;

wherein the sealing section seals an area of the flow passage formation section corresponding to both the liquid supply passage partition wall parts and the liquid supply passage of the flow passage formation section, and the sealing section has a first area and a second area being greater in thickness than the first area;

wherein both the first area and the second area are opposed to the liquid supply passage;

wherein the head case section is separated by a vacancy from the sealing section at the first area opposed to the liquid supply passage;

wherein the sealing section has a first part and a second part being greater in thickness than the first part;

wherein the first area of the sealing section is formed with the first part;

wherein the second area of the sealing section is formed with the first part and the second part;

wherein the head case section, provided on the flow passage formation section through the sealing section, has an expansion coefficient different from that of the flow passage formation section;

wherein the flow passage formation section includes a plurality of island portions which are formed in the liquid supply passages respectively along a longitudinal direction of the liquid supply passages to prevent pressure leakage of the pressure generation parts;

wherein the second part is formed corresponding to the island portions of the flow passage formation section where the head case section is placed;

wherein the second part has a width smaller than a width of the corresponding island portion; and wherein the first part of the sealing section is formed corresponding to the liquid supply passage partition wall part where the head case section is placed.

6. A liquid ejecting apparatus, comprising:

a liquid ejecting head including:

a flow passage formation section having:

a plurality of nozzle openings, ejecting liquid therefrom;

a plurality of pressure generation parts, corresponding to the nozzle openings respectively;

a plurality of partition wall parts, each separating one liquid supply passage and its corresponding pressure generation part from another liquid supply passage and its corresponding pressure generation part;

a sealing section, sealing the flow passage formation section; and a head case section, provided on the sealing section, wherein the partition wall parts respectively include liquid supply passage partition wall parts which separate adjacent liquid supply passages;

wherein the sealing section seals an area of the flow passage formation section corresponding to both the liquid supply passage partition wall parts and the liquid supply passage of the flow passage formation section, and the sealing section has a first area and a second area being greater in thickness than the first area;

wherein both the first area and the second area are opposed to the liquid supply passage;

wherein the head case section is separated by a vacancy from the sealing section at the first area opposed to the liquid supply passage;

wherein the sealing section has a first part and a second part being greater in thickness than the first part;

wherein the first area of the sealing section is formed with the first part;

wherein the second area of the sealing section is formed with the first part and the second part;

wherein the head case section, which is provided on the flow passage formation section through the sealing section, has an expansion coefficient different from that of the flow passage formation section;

wherein the second part is placed in the liquid supply passage partition wall parts; and wherein the second part to which the head case section is joined has a width smaller than a width of the corresponding liquid supply passage partition wall part.

* * * * *